US010406805B2

(12) United States Patent
Hosokawa et al.

(10) Patent No.: US 10,406,805 B2
(45) Date of Patent: Sep. 10, 2019

(54) LIQUID DISCHARGING APPARATUS AND CONTROL METHOD OF LIQUID DISCHARGING APPARATUS

(71) Applicant: SEIKO EPSON CORPORATION, Tokyo (JP)

(72) Inventors: Yasuhiro Hosokawa, Nagano (JP); Toshiyuki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/593,751

(22) Filed: May 12, 2017

(65) Prior Publication Data

US 2018/0001621 A1 Jan. 4, 2018

(30) Foreign Application Priority Data

Jun. 30, 2016 (JP) ..... 2016-130635

(51) Int. Cl.
*B41J 29/38* (2006.01)
*B41J 2/045* (2006.01)

(52) U.S. Cl.
CPC ..... *B41J 2/0451* (2013.01); *B41J 2/04586* (2013.01)

(58) Field of Classification Search
None
See application file for complete search history.

(56) References Cited

U.S. PATENT DOCUMENTS

2009/0244164 A1* 10/2009 Nakamaki ..... B41J 2/16579 347/19
2010/0053250 A1* 3/2010 Ito ..... B41J 29/38 347/16
2011/0090270 A1* 4/2011 Harada ..... B41J 2/16532 347/9
2011/0090277 A1* 4/2011 Pomerantz ..... B41J 3/28 347/20
2016/0279932 A1* 9/2016 Kamiyanagi ..... B41J 2/04588

FOREIGN PATENT DOCUMENTS

JP 2004-174816 A 6/2004

* cited by examiner

*Primary Examiner* — Matthew Luu
*Assistant Examiner* — Tracey M McMillion

(57) ABSTRACT

A liquid discharging apparatus includes a plurality of dischargers that discharge a liquid, a determination portion that determines discharge states of the liquid in the dischargers, and a controller that controls the plurality of dischargers, in which, in a case in which the determination portion determines that the discharge state of the liquid in one discharger is abnormal, the controller controls the plurality of dischargers so as to cause the liquid to be discharged from another discharger instead of causing the liquid to be discharged from the one discharger until a predetermined time has elapsed since determination, and controls the plurality of dischargers so that a repair operation, which repairs the discharge state of the liquid in the one discharger to normal, is caused to be executed after the predetermined time has elapsed since the determination.

6 Claims, 15 Drawing Sheets

FIG. 11

| Sd[m] | DESIGNATED CONTENT OF Sd[m] | SLa[m] | | SLb[m] | | | SLs[m] | | |
|---|---|---|---|---|---|---|---|---|---|
| | | Tu1 | Tu2 | TSS1 | TSS2 | TSS3 | TSS1 | TSS2 | TSS3 |
| (1, 1, 0) | LARGE DOT | H | H | L | L | L | L | L | L |
| (1, 0, 0) | MEDIUM DOT | H | L | L | L | L | L | L | L |
| (0, 1, 0) | SMALL DOT | L | H | L | L | L | L | L | L |
| (0, 0, 0) | NO RECORDING | L | L | L | L | L | L | L | L |
| (1, 1, 1) | DETERMINATION TARGET | L | L | H | L | H | L | H | L |

FIG. 12

| Info-S | Info-T (NTc COMPARISON CONTENT) | Str |
|---|---|---|
| 1 | NTc < Tth1 | 2: DISCHARGE ABNORMALITY (AIR BUBBLE) |
| | Tth1 ≤ NTc ≤ Tth2 | 1: NORMAL |
| | Tth2 < NTc ≤ Tth3 | 3: DISCHARGE ABNORMALITY (FOREIGN MATTER) |
| | Tth3 < NTc | 4: DISCHARGE ABNORMALITY (THICKENING) |
| 0 | N/A | 5: DISCHARGE ABNORMALITY |

LIQUID DISCHARGING APPARATUS AND CONTROL METHOD OF LIQUID DISCHARGING APPARATUS

This application claims priority to Japanese Patent Application No. 2016-130635 filed on Jun. 30, 2016. The entire disclosure of Japanese Patent Application No. 2016-130635 is hereby incorporated herein by reference.

BACKGROUND

1. Technical Field

The present invention relates to a liquid discharging apparatus and a control method of a liquid discharging apparatus.

2. Related Art

A liquid discharging apparatus such as an ink jet printer executes a printing process that forms an image on a recording medium by causing a liquid such as ink to be discharged from each of a plurality of dischargers provided in a head unit. In such a liquid discharging apparatus, there are cases in which a discharge abnormality, in which it is no longer possible to discharge a liquid from the dischargers normally, occurs as a result of thickening, or the like, of the liquid inside the dischargers. Further, when a discharge abnormality occurs, it is no longer possible to accurately form intended dots, which are formed on a recording medium by the liquid discharged from the dischargers, and therefore, the image quality of an image formed on the recording medium in a printing process, is reduced. In order to prevent this kind of deterioration in image quality caused by a discharge abnormality, various techniques relating to so-called supplementary printing, which forms dots by causing an ink to be discharged from another discharger instead of causing the ink to be discharged from one discharger in a case in which a discharge abnormality has occurred in the one discharger, have been proposed (for example, JP-A-2004-174816).

Incidentally, in the above-mentioned manner, in supplementary printing, the discharge of a liquid from a discharger in which a discharge abnormality has occurred is stopped. Therefore, for example, when supplementary printing is executed in a case in which a discharge abnormality caused by thickening of a liquid inside a discharger, has occurred, there are cases in which the extent of the thickening of the liquid inside the discharger in which the discharge abnormality has occurred continues to increase, and therefore, it is even difficult to repair the discharge abnormality by using if a maintenance process such as flushing.

SUMMARY

An advantage of some aspects of the invention is to provide a technique that prevents the occurrence of a discharge abnormality that cannot be repaired even if a maintenance process is used in a case in which supplementary printing is performed.

According to an aspect of the invention, there is provided a liquid discharging apparatus including a plurality of dischargers that discharge a liquid, a determination portion that determines discharge states of the liquid in the dischargers, and a controller that controls the plurality of dischargers, in which, in a case in which the determination portion determines that the discharge state of the liquid in one discharger is abnormal, the controller controls the plurality of dischargers so as to cause the liquid to be discharged from another discharger instead of causing the liquid to be discharged from the one discharger until a predetermined time has elapsed since determination, and controls the plurality of dischargers so that a repair operation, which repairs the discharge state of the liquid in the one discharger to normal, is caused to be executed after the predetermined time has elapsed since the determination.

According to the aspect of the invention, since the repair operation is performed after the predetermined time has elapsed since the determination of the discharge states of the liquid in the dischargers, in comparison with a case in which the discharge of the liquid from the dischargers is continued after the predetermined time has elapsed since the determination, it is possible to reduce the likelihood that the discharge state of the liquid in the one discharger will deteriorate.

In the above-mentioned liquid discharging apparatus, the repair operation may be an operation in which the plurality of dischargers discharge the liquid.

According to such a configuration, since the liquid is discharged from the plurality of dischargers including the one discharger, in a case in which an abnormality in the discharge state, which is caused by thickening of the liquid, occurs in the one discharger, it is possible to resolve the abnormality in the discharge state.

According to another aspect of the invention, there is provided a liquid discharging apparatus including a plurality of dischargers that discharge a liquid, a determination portion that determines discharge states of the liquid in the dischargers, a repair mechanism that repairs the discharge state of the liquid in a discharger to normal in a case in which the discharge state of the liquid in the one discharger becomes abnormal, and a controller that controls the plurality of dischargers and the repair mechanism, in which, in a case in which the determination portion determines that the discharge state of the liquid in one discharger is abnormal, the controller controls the plurality of dischargers so as to cause the liquid to be discharged from another discharger instead of causing the liquid to be discharged from the one discharger until a predetermined time has elapsed since determination, and controls the repair mechanism so that a repair operation, which repairs the discharge state of the liquid in the one discharger to normal, is caused to be executed after the predetermined time has elapsed since the determination.

In the aspect of the invention, since the repair operation is performed after the predetermined time has elapsed since the determination of the discharge states of the liquid in the dischargers, in comparison with a case in which the discharge of the liquid from the dischargers is continued after the predetermined time has elapsed since the determination, it is possible to reduce the likelihood that the discharge state of the liquid in the one discharger will deteriorate.

In the above-mentioned liquid discharging apparatus, the repair operation may be an operation in which the repair mechanism suctions the liquid from the plurality of dischargers.

According to such a configuration, since the liquid is suctioned from the plurality of dischargers including the one discharger, in a case in which an abnormality in the discharge state, which is caused by thickening of the liquid, occurs in the one discharger, it is possible to resolve the abnormality in the discharge state.

The above-mentioned liquid discharging apparatus may further include a driving signal generation portion that generates a first driving signal that drives the dischargers in a manner in which the liquid is discharged from the dischargers, and a second driving signal that drives the dischargers in a manner in which the liquid is not discharged from the dischargers, and a switching portion that switches between supplying the first driving signal to the dischargers, and supplying the second driving signal to the dischargers, in which, in a case in which the determination portion determines that the discharge state of the liquid in one discharger is abnormal, the controller controls the switching portion so that the first driving signal and the second driving signal are not supplied to the one discharger until a predetermined time has elapsed after the determination.

According to such a configuration, in a case in which an abnormality in the discharge state, which is caused by thickening of the liquid, occurs in the one discharger, it is possible to prevent the thickened liquid from spreading in the inner portion of the one discharger.

According to still another aspect of the invention, there is provided a control method of a liquid discharging apparatus, which includes a plurality of dischargers that discharge a liquid, and a determination portion that determines discharge states of the liquid in the dischargers, the method including, in a case in which the determination portion determines that the discharge state of the liquid in one discharger is abnormal, controlling the plurality of dischargers so as to cause the liquid to be discharged from another discharger instead of causing the liquid to be discharged from the one discharger until a predetermined time has elapsed since determination, and controlling the plurality of dischargers so that a repair operation, which repairs the discharge state of the liquid in the one discharger to normal, is caused to be executed after the predetermined time has elapsed since the determination.

In the aspect of the invention, since the repair operation is performed after the predetermined time has elapsed since the determination of the discharge states of the liquid in the dischargers, in comparison with a case in which the discharge of the liquid from the dischargers is continued after the predetermined time has elapsed since the determination, it is possible to reduce the likelihood that the discharge state of the liquid in the one discharger will deteriorate.

BRIEF DESCRIPTION OF THE DRAWINGS

The invention will be described with reference to the accompanying drawings, wherein like numbers reference like elements.

FIG. 11 is an explanatory view that shows decoding contents of a decoder.

FIG. 12 is an explanatory view for describing determination information.

DESCRIPTION OF EXEMPLARY EMBODIMENTS

Hereinafter, aspects for implementing the invention will be described with reference to the drawings. However, in each drawing, the dimensions and scales of each portion have been altered from practical dimensions and scales as appropriate. In addition, since the embodiment that is mentioned below is a preferred specific example of the invention, various technically preferable limitations have been applied thereto, but the scope of the invention is not limited to these embodiments unless a feature that specifically limits the invention is disclosed in the following description.

A. Embodiment

In the present embodiment, a liquid discharging apparatus will be described by illustrating an ink jet printer that forms images on recording sheets P (an example of a "medium") by discharging an ink (an example of a "liquid"), by way of example.

1. Outline of Ink Jet Printer

Figure 1:
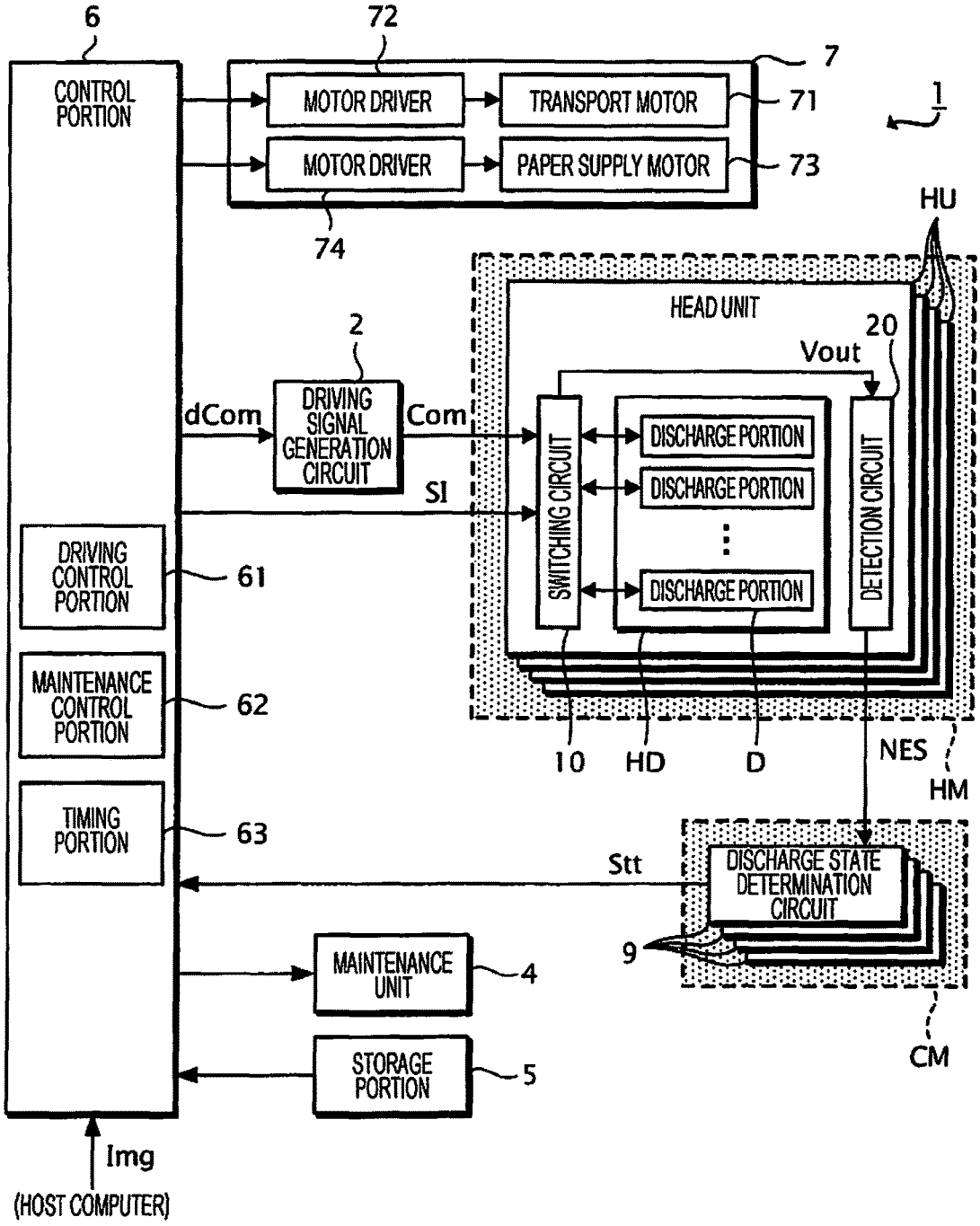
FIG. 1 is a block diagram that shows a configuration of an ink jet printer according to the invention.
Figure 2:
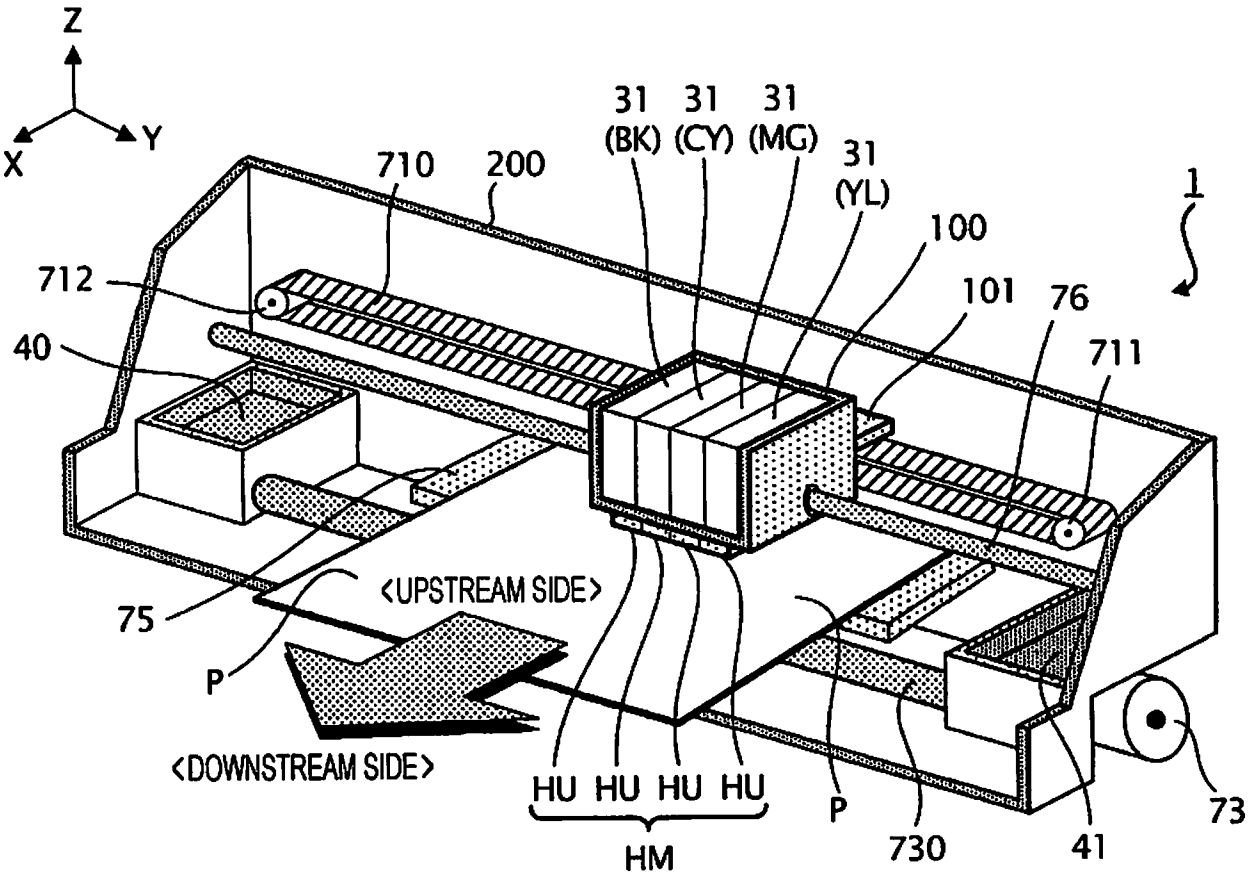
FIG. 2 is a perspective view that shows a schematic internal structure of the ink jet printer.

The configuration of an ink jet printer 1 according to the present embodiment will be described with reference to FIGS. 1 and 2. In this instance, FIG. 1 is a functional block diagram that shows an example of a configuration of the ink jet printer 1 according to the present embodiment. In addition, FIG. 2 is a perspective view that shows an example of a schematic internal structure of the ink jet printer 1.

Printing data Img, which shows images that the ink jet printer 1 should form, and information, which shows a printing copy number of images that the ink jet printer 1 should form, are supplied to the ink jet printer 1 from a host computer such as a personal computer or a digital camera. The ink jet printer 1 executes a printing process that forms an image, which is shown by the printing data Img supplied from the host computer, on a recording sheet P.

As illustrated by way of example in FIG. 1, the ink jet printer 1 is provided with a head module HM including head units HU in which dischargers D that discharge an ink are provided, a controller 6 that controls the operations of each portion of the ink jet printer 1, a driving signal generation circuit 2 (an example of a "driving signal generation portion") that generates a driving signal Com for driving the dischargers D, a transport mechanism 7 for bringing about a change in the relative position of a recording sheet P with respect to the head module HM, a determination module CM including discharge state determination circuits 9 (an example of a "determination portion") that determine discharge states of the ink in dischargers D (hereinafter, there are cases in which this is referred to as a "discharge state determination") and output determination information Stt, which shows the result of the discharge state determination, a storage portion 5 that stores a control program of the ink jet printer 1 and other information, and a maintenance unit 4 that, in a case in which the discharge state of the ink in a discharger D becomes abnormal, executes a maintenance process (an example of a "repair operation") that repairs the discharge state of the ink in the discharger D to normal.

In the present embodiment, as illustrated by way of example in FIG. 1, a case in which the head module HM is provided with four head units HU and the determination module CM is provided with four discharge state determination circuits 9 to correspond to the four head units HU on a one-to-one basis is assumed.

In the present embodiment, each head unit HU is provided with a recording head HD including M dischargers D, a switching circuit 10 (an example of a "switching portion"), and a detection circuit 20 (in the present embodiment, M is a nonnegative integer that satisfies $2 \leq M$).

Hereinafter, there are cases in which the respective M dischargers D provided in each recording head HD are referred to, in order, as a first stage, a second stage, . . . , and an Mth stage in order to discriminate therebetween. In addition, there are cases in which an $m^{th}$ stage discharger D is referred to as a discharger DM (the variable m is a nonnegative integer that satisfies $1 \leq m \leq M$). In addition, in a case in which a constituent element, a signal, or the like, of the ink jet printer 1 corresponds to a stage number m of the discharger D[m], there are cases in which this is represented by assigning the suffix [m], which shows the correspondence to the stage number m, to the reference symbol for indicating the constituent element, signal, or the like.

The switching circuit 10 switches between whether or not to supply the driving signal Com, which is output from the driving signal generation circuit 2, to each discharger D. In addition, the switching circuit 10 switches between whether or not to electrically connect each discharger D and the detection circuit 20.

The detection circuit 20 generates a residual vibration signal NES[m], which shows vibrations (hereinafter, referred to as "residual vibrations") that remain in a discharger D[m] after the discharger D[m] is driven, on the basis of a detection signal Vout[m] detected from the discharger D[m] driven by the driving signal Com.

Each discharge state determination circuit 9 generates determination information Stt[m], which shows a result of discharge state determination of a discharger D[m] on the basis of a residual vibration signal NES[m]. Additionally, hereinafter, there are cases in which a discharger D that is the target of discharge state determination by a discharge state determination circuit 9 is referred to as a determination target discharger D-H. In addition, a series of processes including discharge state determination that the discharge state determination circuits 9 execute and a preparation process in order for the discharge state determination circuits 9 to execute discharge state determination, which is executed in the ink jet printer 1, will be referred to as a discharge state determination process.

In the present embodiment, a case in which the ink jet printer 1 is a serial printer is assumed. More specifically, the ink jet printer 1 executes a printing process by discharging the ink from the dischargers D while transporting a recording sheet P in a sub-scanning direction and moving the head module HM in a main scanning direction. In the present embodiment, as shown in FIG. 2, a +Y direction and a −Y direction (hereinafter, the +Y direction and the −Y direction will be collectively referred to as a "Y axis direction") are the main scanning direction, and a +X direction (hereinafter, the +X direction and a −X direction, which is opposite thereto, will be collectively referred to as an "X axis direction") is the sub-scanning direction.

As illustrated by way of example in FIG. 2, the ink jet printer 1 according to the present embodiment is provided with a housing 200, and a carriage 100 in which the head module HM, which is capable of reciprocating in the Y axis direction inside the housing 200, is mounted.

In a case in which a printing process is executed, as a result of the transport mechanism 7 causing the carriage 100 to reciprocate in the Y axis direction and transporting a recording sheet P in the +X direction, it is possible for the ink to be deposited on the entirety of the recording sheet P by bringing about a change in the relative position of the recording sheet P with respect to the head module HM.

More specifically, as shown in FIG. 1, the transport mechanism 7 includes a transport motor 71 that functions as a driving source for causing the carriage 100 to reciprocate in the Y axis direction, a motor driver 72 for driving the transport motor 71, a paper supply motor 73 that functions as a driving source for transporting the recording sheets P, and a motor driver 74 for driving the paper supply motor 73. In addition, as shown in FIG. 2, the transport mechanism 7 includes a carriage guide shaft 76 that extends in the Y axis direction, and a timing belt 710 that is stretched between a pulley 711, which is driven in a rotational manner by the transport motor 71, and a pulley 712, which is capable of freely rotating, and extends in the Y axis direction. The carriage 100 is supported by the carriage guide shaft 76 so as to be capable of freely reciprocating in the Y axis direction, and is fixed to a predetermined location of the timing belt 710 by using a fixing tool 101. Therefore, as a result of causing the pulley 711 to be driven in a rotational manner by the transport motor 71, it is possible for the transport mechanism 7 to move the head module HM, which is mounted to the carriage 100, in the Y axis direction along the carriage guide shaft 76.

In addition, as shown in FIG. 2, the transport mechanism 7 is provided with a platen 75, which is provided on the lower side of the carriage 100, that is, in a −Z direction (hereinafter, the −Z direction and a +Z direction, which is opposite thereto, will be collectively referred to as an "Z axis direction"), a paper supply roller (not illustrated in the drawings) for supplying the recording sheets P onto the platen 75 one sheet at a time by rotating in accordance with driving of the paper supply motor 73, and a paper ejection roller 730 that transports the recording sheets P on the platen 75 to a paper ejection opening by rotating in accordance with the driving of the paper supply motor 73. Therefore, the transport mechanism 7 can transport the recording sheets P in the +X direction (to the downstream side) from the −X direction (to the upstream side) on the platen 75.

The maintenance unit 4 is provided with a cap 40 for covering each of the head units HU so that nozzles N of the dischargers D are sealed, a wiper (not illustrated in the drawings) for wiping away foreign matter such as paper debris adhered to the vicinity of the nozzles N (refer to FIG. 3 which will be mentioned later) of the dischargers D, a tube pump (not illustrated in the drawings) for suctioning ink, air bubbles, and the like, inside the dischargers D, and an ejected ink reception portion 41 for receiving ink ejected in a case in which ink inside the dischargers D is ejected. Additionally, in the present embodiment, an aspect in which the cap 40 is attached to the housing 200 is illustrated by way of example, but the invention is not limited to such an aspect, and the cap 40 may be attached to the carriage 100.

In addition, in the present embodiment, as illustrated by way of example in FIG. 2, a case in which four ink cartridges 31, which correspond to the four colors (CMYK) of ink of cyan (C), magenta (M), yellow (Y), and black (K) on a one-to-one basis, are stored in the carriage 100, is assumed. Additionally, FIG. 2 is merely one example, and the ink cartridge 31 may be provided in the outer portion of the carriage 100.

In addition, in the present embodiment, the four head units HU and the four ink cartridges 31 are provided to correspond to one another on a one-to-one basis. Further, each of the dischargers D receives the supply of ink from the ink cartridge 31 that corresponds to the head unit HU in which the discharger D is provided. As a result of this, the inner portion of each discharger D is filled with the supplied ink, and each discharger D can discharge the ink, with which it is filled, from the nozzles N. In other words, in total, the total of 4M dischargers D that the head module HM includes can discharge the four colors of ink of CMYK.

The storage portion 5 is configured to include volatile memory such as random access memory (RAM), non-volatile memory such as read-only memory (ROM), electrically erasable programmable read only memory (EEPROM), or programmable ROM (PROM), and stores the printing data Img supplied from the host computer and various information such as a control program of the ink jet printer 1.

The controller 6 is configured to include a central processing unit (CPU). However, the controller 6 may also be provided with a programmable logic device such as a field-programmable gate array (FPGA) instead of the CPU.

As a result of the CPU provided in the controller 6 operating in accordance with the control program stored in the storage portion 5, the controller 6 functions as a driving controller 61 that controls the driving signal generation circuit 2, the head module HM, and the transport mechanism 7, a maintenance controller 62 (an example of a "repair controller") that controls the maintenance unit 4, and a timing portion 63 that times the time since the determination of the discharge states of the ink in the dischargers D was carried out.

The driving controller 61 generates a printing signal SI for controlling the head module HM, a waveform designation signal dCom for controlling the driving signal generation circuit 2, and a signal for controlling the transport mechanism 7.

In this instance, the waveform designation signal dCom is a digital signal that stipulates the waveform of the driving signal Com. In addition, the driving signal Com is an analog signal for driving the dischargers D. The driving signal generation circuit 2 includes a DA conversion circuit, and generates a driving signal Com that includes a waveform that the waveform designation signal dCom stipulates. Additionally, in the present embodiment, a case in which the driving signal Com includes a driving signal Com-A and a driving signal Com-B is assumed.

In addition, the printing signal SI is a digital signal for designating the type of operation of the dischargers D. More specifically, the printing signal SI designates the type of operation of the dischargers D by designating whether or not to supply the driving signal Com to the dischargers D. In this instance, for example, the designation of the type of operation of the dischargers D refers to designating whether or not to drive the dischargers D, designating whether or not the ink is discharged from a discharger D when driving the discharger D, designating the ink amount to be discharged from a discharger D when driving the discharger D, or the like.

In a case in which a printing process is executed, firstly, the driving controller 61 causes the printing data Img supplied from the host computer to be stored in the storage portion 5. Next, the driving controller 61 generates various control signals such as the printing signal SI, the waveform designation signal dCom, and the signal for controlling the transport mechanism 7, on the basis of various data such as the printing data Img stored in the storage portion 5. Further, the driving controller 61 controls the head module HM in a manner in which the dischargers D are driven while controlling the transport mechanism 7 so as to bring about a change in the relative position of a recording sheet P with respect to the head module HM on the basis of various control signals and various data stored in the storage portion 5. As a result of this, the driving controller 61 controls the execution of a printing process that forms an image that corresponds to the printing data Img on the recording sheet P by adjusting the presence or absence of the discharge of ink from the dischargers D, the discharge amount of ink, the discharge timing of ink, and the like.

In the above-mentioned manner, the ink jet printer 1 according to the present embodiment executes a discharge state determination process, which determines whether or not the discharge state of the ink from each discharger D is normal, that is, whether or not a discharge abnormality has occurred in each discharger D.

In this instance, a discharge abnormality is a state in which it is not possible to discharge the ink by using an aspect that the driving signal Com stipulates despite an attempt being made to cause the ink to be discharged from the dischargers D by driving the dischargers D by using the driving signal Com. In this instance, a discharge mode of ink that the driving signal Com stipulates is when the dischargers D discharge ink of an amount stipulated by the waveform of the driving signal Com and the dischargers D discharge the ink at a discharge speed stipulated by the waveform of the driving signal Com. That is, in addition to a state in which it is not possible to discharge the ink from the dischargers D, a state in which it is not possible to discharge the ink by using a discharge mode of ink that the driving signal Com stipulates includes a state in which ink of an amount that is less than the discharge amount of ink stipulated by the driving signal Com is discharged from the dischargers D, a state in which ink of an amount that is greater than the discharge amount of ink stipulated by the driving signal Com is discharged from the dischargers D, a state in which it is possible to cause the ink to be deposited in a desired deposition position on a recording sheet P due to the ink being discharged at a speed that differs from the discharge speed of the ink stipulated by the driving signal Com, and the like.

In a discharge state determination process, the ink jet printer 1 executes a series of processes of first, selecting a determination target discharger D-H from among the M dischargers D provided in each head unit HU by using the driving controller 61, second, causing residual vibrations to occur in the determination target discharger D-H by causing the determination target discharger D-H to be driven according to the control of the driving controller 61, third, generating a residual vibration signal NES on the basis of a detection signal Vout detected from the determination target discharger D-H by a detection circuit 20, fourth, performing discharge state determination, on the basis of the residual vibration signal NES, with the determination target discharger D-H as the target thereof and generating determination information Stt, which shows the result of the determination, by using the discharge state determination circuit 9, and fifth, causing the determination information Stt to be stored in the storage portion 5 by using the controller 6.

In the above-mentioned manner, the ink jet printer 1 according to the present embodiment executes a maintenance process, which repairs the discharge state of the ink in dischargers D in which a discharge abnormality has occurred to be repaired to normal.

More specifically, a maintenance process is a collective term for processes for returning the discharge states of the ink in the dischargers D to normal such as a flushing process that causes the ink to be ejected from the dischargers D, a wiping process that wipes away foreign matter adhered to the vicinity of the nozzles N of the dischargers D by using the wiper, a pumping process that suctions ink, air bubbles, and the like, inside the dischargers D by using the tube pump, and the like.

In a flushing process, the ink jet printer 1 causes the ink to be discharged into the ejected ink reception portion 41 by, first, moving the head module HM to the upper side (the +Z direction) of the ejected ink reception portion 41 according to the control of the driving controller 61, and second, causing the 4M dischargers D provided in the head module HM to be driven according to the control of the driving controller 61.

In addition, in a wiping process, the ink jet printer 1 wipes away foreign matter adhered to each discharger D by first, moving the head module HM to the upper side of the wiper according to the control of the driving controller 61, and second, causing the wiper to be driven according to the control of the maintenance controller 62.

In addition, in a pumping process, the ink jet printer 1 suctions the ink inside the 4M dischargers D provided in the head module HM by first, moving the head module HM to the upper side of the tube pump according to the control of the driving controller 61, and second, causing the tube pump to be driven according to the control of the maintenance controller 62.

In addition, there are cases in which the ink jet printer 1 according to the present embodiment executes a supplementary printing process that forms an image according to the printing data Img on a recording sheet P by causing the ink to be discharged from a discharger D in which the discharge state is normal as a printing process instead of a discharger D in which the discharge state has become abnormal.

More specifically, in a case in which a discharge abnormality has occurred in one discharger D, a supplementary printing process is a printing process that substitutes (supplements) the role of the one discharger D with another discharger D, which differs from the one discharger D, as a result of increasing the discharge amount of the ink from the other discharger D instead of causing the ink to be discharged from the one discharger D. Additionally, hereinafter, there are cases in which a printing process other than a supplementary printing process, that is, a printing process executed without supplementing any of the dischargers D with another discharger D, is referred to as a normal printing process.

In a supplementary printing process, the driving controller 61, firstly, in a case in which a discharge abnormality has occurred in one discharger D, selects another discharger D that is capable of supplementing the one discharger D, and secondly, controls the switching circuit 10 so as to stop the supply of the driving signal Com to the one discharger D driving control and controls the switching circuit 10 so as to supplement the one discharger D by using the other discharger D as a result of increasing the discharge amount of the ink from the other discharger D. As a result of this, even in a case in which a discharge abnormality has occurred in the one discharger D, it is possible to allow a printing process to continue without stopping the printing process and performing a maintenance process.

Additionally, in a case in which the one discharger D is supplemented by using another discharger D, the term "increasing the discharge amount of the ink from another discharger D" includes a case in which the ink is discharged as a result of another discharger D, which would not be expected to discharge the ink if a normal printing process was being executed, executing a supplementary printing process.

Hereinafter, there are cases in which, in a printing process, a discharger D for which supplementation with another discharger D is necessary due to a discharge abnormality having occurred is referred to as an abnormal discharger D-F, and in which, in a supplementary printing process, a discharger D that supplements an abnormal discharger D-F is referred to as a supplementary discharger D-Q.

2. Outline of Recording Heads and Dischargers

The recording heads HD and the dischargers D provided in the recording heads HD will be described with reference to FIGS. 3 and 5.

Figure 3:
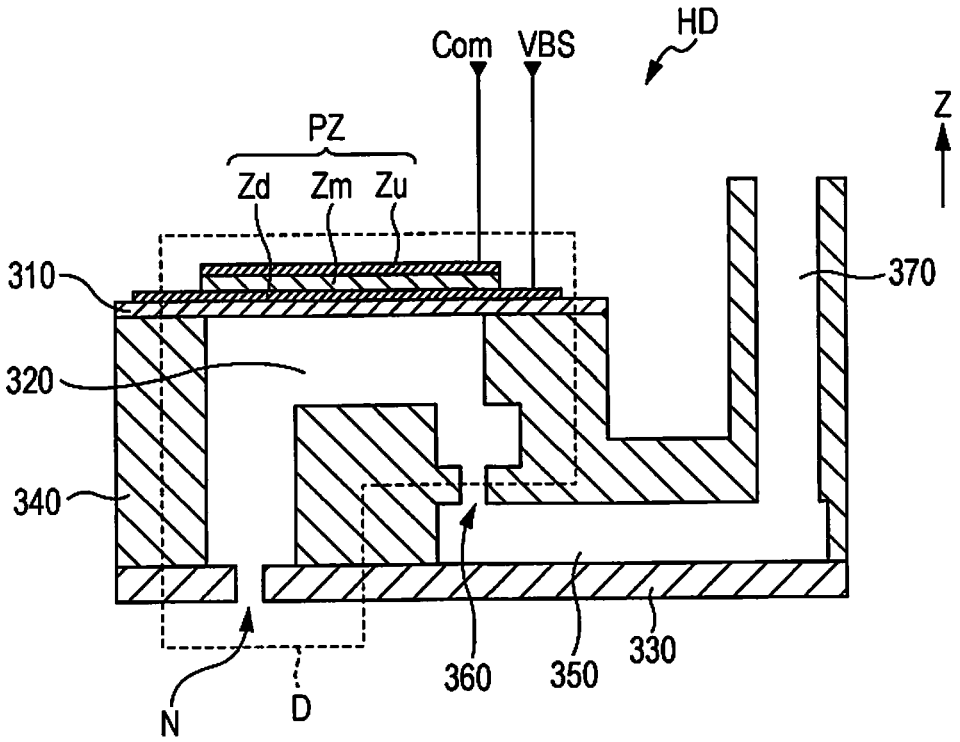
FIG. 3 is an explanatory view for describing a structure of a discharger.

FIG. 3 is a schematic partial cross-sectional view of a recording head HD in which the recording head HD is sectioned so as to include a discharger D.

As shown in FIG. 3, the discharger D is provided with a piezoelectric element PZ, a cavity 320 (an example of a "pressure chamber"), the inner portion of which is filled with the ink, a nozzle N that is in communication with the cavity 320, and a vibration plate 310. The discharger D causes the ink inside the cavity 320 to be discharged from the nozzle N as a result of the driving signal Com being supplied to the piezoelectric element PZ and the piezoelectric element PZ being driven by the driving signal Com. The cavity 320 is a space that is partitioned by a cavity plate 340, a nozzle plate 330 in which the nozzle N is formed, and the vibration plate 310. The cavity 320 is in communication with a reservoir 350 through an ink supply opening 360. The reservoir 350 is in communication with an ink cartridge 31 that corresponds to the discharger D through an ink inlet 370.

In the present embodiment, a unimorph (monomorph) type piezoelectric element such as that shown in FIG. 3, is adopted as the piezoelectric element PZ. Additionally, the piezoelectric element PZ is not limited to a unimorph type, and may adopt a bimorph type, a lamination type or the like.

The piezoelectric element PZ includes an upper portion electrode Zu, a lower portion electrode Zd, and a piezoelectric body Zm provided between the upper portion electrode Zu and the lower portion electrode Zd. Further, when the lower portion electrode Zd is electrically connected to an electrical supply line LHd (refer to FIG. 7), which is set to a potential VBS, and a voltage is applied between the upper portion electrode Zu and the lower portion electrode Zd as a result of the driving signal Com being supplied to the upper portion electrode Zu, the piezoelectric element PZ is displaced in the +Z direction and the −Z direction according to the applied voltage, and the piezoelectric element PZ vibrates as a result.

The vibration plate 310 is installed in an upper surface opening portion of the cavity plate 340. The lower portion electrode Zd is joined to the vibration plate 310. Therefore, when the piezoelectric element PZ vibrates as a result of being driven by the driving signal Com, the vibration plate 310 also vibrates. Further, the volume of the cavity 320 changes due to the vibrations of the vibration plate 310, and ink, with which the inside of the cavity 320 is filled, is discharged by the nozzle N. In a case in which the ink inside the cavity 320 is reduced due to discharge of the ink, the ink is supplied from the reservoir 350.

Figure 4:
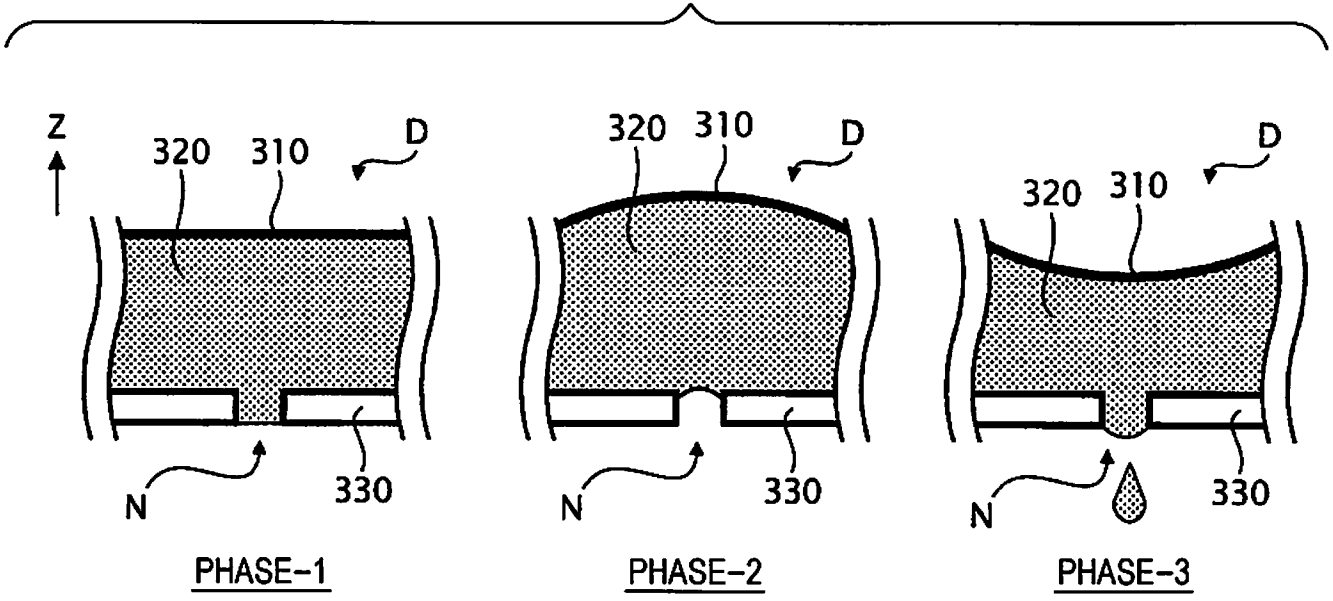
FIG. 4 is an explanatory view for describing a discharge operation of ink in the discharger.

FIG. 4 is an explanatory view for describing an example of a discharge operation of the ink in a discharger D. As illustrated by way of example in FIG. 4, in the state of Phase-1, as a result of causing the potential of the driving signal Com supplied to the piezoelectric element PZ that the discharger D is provided with to change, the driving controller 61 causes distortion that acts in a manner in which the piezoelectric element PZ is displaced in the +Z direction to be generated, and causes the vibration plate 310 of the discharger D to warp in the +Z direction. As a result of this, in comparison with the state of Phase-1, the volume of the cavity 320 of the discharger D expands in the manner of the state of Phase-2 shown in FIG. 4. Next, as a result of causing the potential that the driving signal Com shows to change, the driving controller 61 causes distortion that acts in a manner in which the piezoelectric element PZ is displaced in the −Z direction to be generated, and causes the vibration plate 310 of the discharger D to warp in the −Z direction. As a result of this, the volume of the cavity 320 contracts rapidly, and a portion of the ink with which the cavity 320 is filled is discharged from the nozzle N, which is in communication with the cavity 320, as an ink droplet in the manner of the state of Phase-3 shown in FIG. 4. After the piezoelectric element PZ and the vibration plate 310 are displaced in the Z axis direction as a result of being driven by the driving signal Com, residual vibrations occur in the discharger D, which includes the vibration plate 310.

Figure 5:
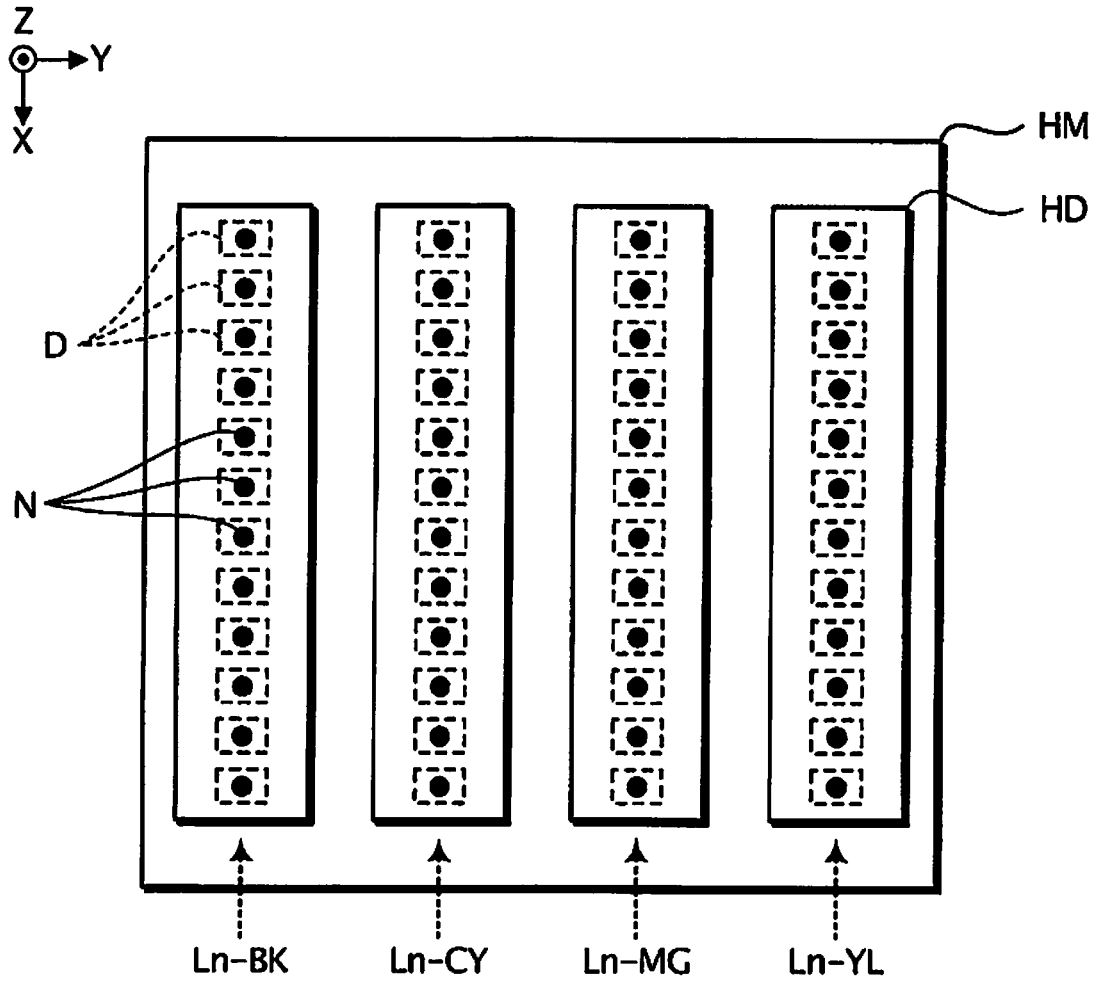
FIG. 5 is a plan view that shows an arrangement example of nozzles in a head module.

FIG. 5 is an explanatory view for describing an example of the disposition of four recording heads HD that the head module HM includes and a total of 4M nozzles N provided in the four recording heads HD in a case in which the ink jet printer 1 is viewed in a planar manner from the +Z direction or the −Z direction.

As shown in FIG. 5, a plurality of nozzle rows Ln are provided in each recording head HD provided in the head module HM. In this instance, a nozzle row Ln is a plurality of nozzles N provided so as to extend in row form in a predetermined direction. In the present embodiment, a case in which each nozzle row Ln is configured by M nozzles N being disposed so as to extend in row form in the X axis direction is assumed.

Hereinafter, as shown in FIG. 5, the four nozzle rows Ln provided in the head module HM will be referred to as nozzle rows Ln-BK, Ln-CY, Ln-MG, and Ln-YL. In this instance, the nozzle row Ln-BK is a nozzle row Ln in which the nozzles N of a discharger D that discharges black ink are arranged, the nozzle row Ln-CY is a nozzle row Ln in which the nozzles N of a discharger D that discharges cyan ink are arranged, the nozzle row Ln-MG is a nozzle row Ln in which the nozzles N of a discharger D that discharges magenta ink are arranged, and the nozzle row Ln-YL is a nozzle row Ln in which the nozzles N of a discharger D that discharges yellow ink are arranged.

Additionally, FIG. 5 is one example, and the M nozzles N that belong to each nozzle row Ln may also be disposed having a predetermined width in a direction that intersects the direction in which the nozzle rows Ln extend. In other words, the M nozzles N belonging to each nozzle row Ln may also be disposed in a staggered form, for example, so that the positions in the Y axis direction from the +X side of even-numbered nozzles N and odd-numbered nozzles N differ from one another in each nozzle row Ln. In addition, each nozzle row Ln may also extend in a direction that differs from the X axis direction. In addition, in the present embodiment, a case in which the number of nozzle rows Ln provided in each recording head HD is "1" is illustrated by way of example, but two or more nozzle rows Ln may be provided in each recording head HD.

3. Outline of Operations of Ink Jet Printer

Hereinafter, an outline of the operations of the ink jet printer 1 will be described with reference to FIG. 6.

Figure 6:
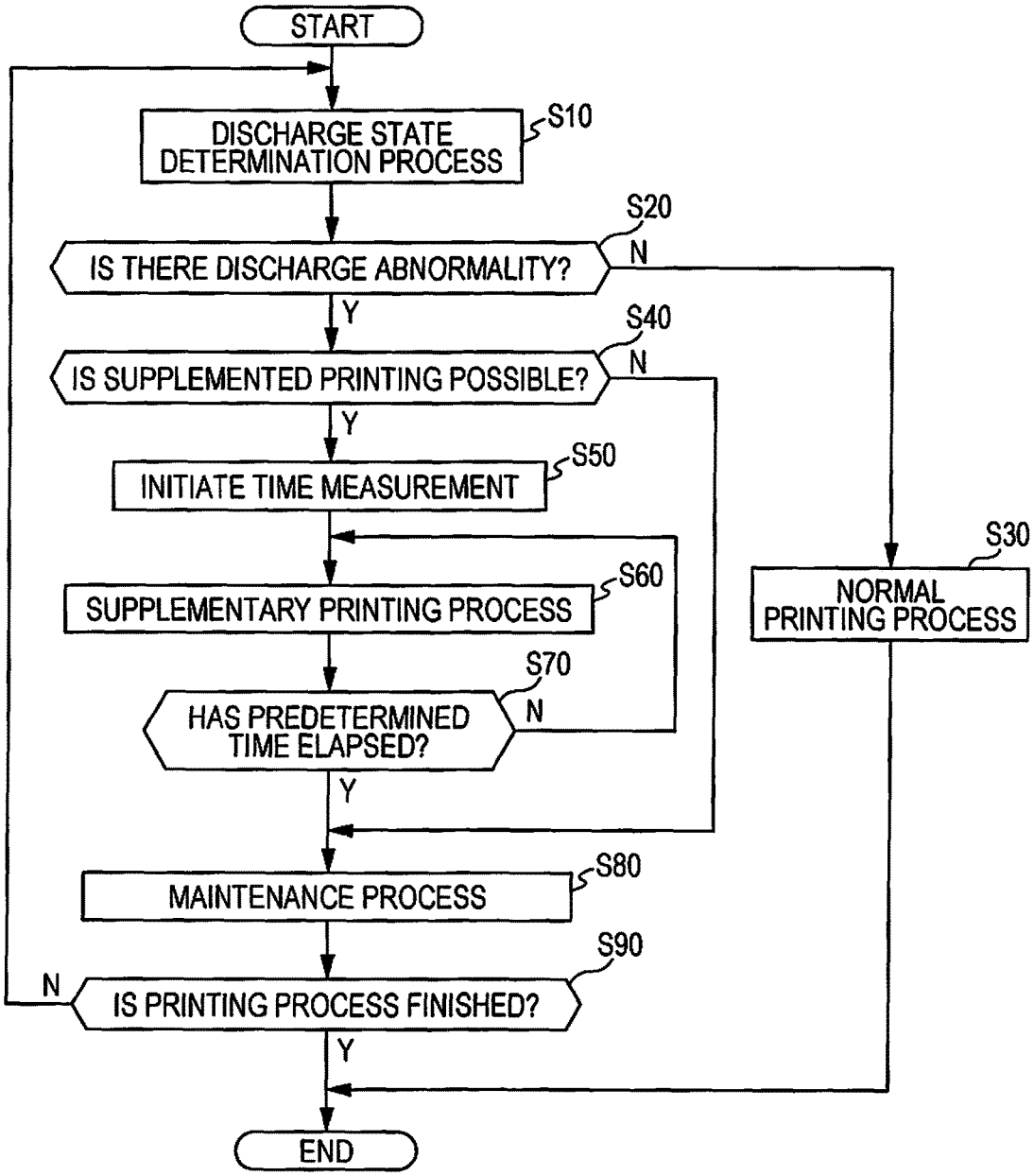
FIG. 6 is a flowchart for describing an operation of the ink jet printer.

FIG. 6 is a flowchart that shows an example of the operations of the ink jet printer 1 in a case in which a printing process is executed.

Additionally, in FIG. 6, a case in which the ink jet printer 1 executes a discharge state determination process before executing a printing process is illustrated by way of example. Additionally, a case in which a discharge state determination process is executed before a printing process is, for example, a case in which the printing process is the first printing process after the power of the ink jet printer 1 is turned on, a case in which the printing process is executed after a constant period of time has elapsed since a printing process executed therebefore, a case in which the printing process is executed after a constant period of time has elapsed since a discharge state determination process, or the like.

In the example shown in FIG. 6, the ink jet printer 1 executes a discharge state determination process (S10) prior to a printing process. Next, the controller 6 of the ink jet printer 1 determines whether or not there is an abnormal discharger D-F, which was determined as having a discharge abnormality in the discharge state determination process executed in Step S10 (S20). Further, in a case in which the determination result of Step S20 is negative, or in other words, in a case in which there is not an abnormal discharger D-F, the ink jet printer 1 executes a normal printing process (S30) and finishes the process shown in FIG. 6.

On the other hand, in a case in which the determination result of Step S20 is affirmative, or in other words, in a case in which there is an abnormal discharger D-F, the controller 6 of the ink jet printer 1 determines whether or not a supplementary printing process is possible (S40). More specifically, in Step S40, in a case in which there are a predetermined number (or predetermined ratio) or fewer abnormal dischargers D-F, and there is a supplementary discharger D-Q that is capable of supplementing each abnormal discharger D-F, the controller 6 determines that a supplementary printing process is possible. Further, in a case in which the determination result of Step S40 is negative, or in other words, in a case in which a supplementary printing process is not possible, the controller 6 of the ink jet printer 1 advances the process to Step S80.

In addition, in a case in which the determination result of Step S40 is affirmative, the controller 6 of the ink jet printer 1 initiates a count (timing) of the elapsed time since the determination (discharge state determination) in Step S10 (S50). In this instance, among times at which the controller 6 acquires 4M items of determination information Stt corresponding to the 4M dischargers D from the determination module CM, the elapsed time since discharge state determination may be the elapsed time since a time at which the first item of determination information Stt was acquired, may be the elapsed time since a time at which the last item of determination information Stt was acquired, or may be the elapsed time since an average time of the times at which the 4M items of determination information Stt were acquired. In addition, among times at which it is estimated that the determination module CM output 4M items of determination information Stt corresponding to the 4M dischargers D, the elapsed time since discharge state determination may be the elapsed time since a time at which it is estimated that the first item of determination information Stt was output, may be the elapsed time since a time at which it is estimated that the last item of determination information Stt was output, or may be the elapsed time since an average time of the times at which it is estimated that the 4M items of determination information Stt were output.

Further, the ink jet printer 1 executes a supplementary printing process after Step S50 (S60).

In addition, the controller 6 of the ink jet printer 1 determines whether or not the elapsed time since discharge state determination in Step S10 has passed a predetermined time (S70). Additionally, the process of Step S70 may be executed in parallel with the process of Step S60. The controller 6 functions as the timing portion 63 by executing the processes of Step S50 and Step S70.

Further, in a case in which the determination result of Step S70 is affirmative, the ink jet printer 1 executes a maintenance process (S80). More specifically, in Step S80, the ink jet printer 1 controls each portion of the ink jet printer 1 so that a flushing process is executed by the driving controller 61.

However, the invention is not limited to such an aspect, and in Step S80, the ink jet printer 1 may control each portion of the ink jet printer 1 so that a wiping process is executed by the driving controller 61 and the maintenance controller 62, or may control each portion of the ink jet printer 1 so that a pumping process is executed by the driving controller 61 and the maintenance controller 62.

In addition, in Step S80, among a flushing process, a wiping process, and a pumping process, the controller 6 of the ink jet printer 1 may control each portion of the ink jet printer 1 so that either a single or a plurality of processes are executed depending on the process result of Step S10. For example, in a case in which an abnormal discharger D-F, in which a discharge abnormality caused by thickening of the ink has occurred, is detected in the discharge state determination process in Step S10, the controller 6 of the ink jet printer 1 may control each portion of the ink jet printer 1 so that a flushing process or a pumping process is executed in Step S80. In addition, for example, in a case in which an abnormal discharger D-F, in which a discharge abnormality caused by the incorporation of an air bubble has occurred, is detected in the discharge state determination process in Step S10, the controller 6 of the ink jet printer 1 may control each portion of the ink jet printer 1 so that a flushing process or a pumping process is executed in Step S80. For example, in a case in which an abnormal discharger D-F, in which a discharge abnormality caused by the attachment of foreign matter has occurred, is detected in the discharge state determination process in Step S10, the controller 6 of the ink jet printer 1 may control each portion of the ink jet printer 1 so that a wiping process is executed in Step S80.

In addition, the controller 6 of the ink jet printer 1 may establish a process to be executed in Step S80 depending on the number of abnormal dischargers D-F determined as having a discharge abnormality in the discharge state determination process in Step S10, or depending on the proportion of abnormal dischargers D-F with respect to the 4M dischargers D provided in the ink jet printer 1. For example, in a case in which an abnormal discharger D-F, in which a discharge abnormality caused by thickening of the ink has occurred, is detected in the discharge state determination process in Step S10, the controller 6 of the ink jet printer 1 may control each portion of the ink jet printer 1 so that a flushing process is executed in Step S80 in a case in which the number of abnormal dischargers D-F is less than a first reference number or in a case in which the proportion of abnormal dischargers D-F is less than a first reference value, and may control each portion of the ink jet printer 1 so that a pumping process is executed in Step S80 in a case in which the number of abnormal dischargers D-F is the first reference number or more or in a case in which the proportion of abnormal dischargers D-F is the first reference value or more. In addition, for example, in a case in which an abnormal discharger D-F, in which a discharge abnormality caused by the incorporation of an air bubble has occurred, is detected in the discharge state determination process in Step S10, the controller 6 of the ink jet printer 1 may control each portion of the ink jet printer 1 so that a flushing process is executed in Step S80 in a case in which the number of abnormal dischargers D-F is less than a second reference number or in a case in which the proportion of abnormal dischargers D-F is less than a second reference value, and may control each portion of the ink jet printer 1 so that a pumping process is executed in Step S80 in a case in which the number of abnormal dischargers D-F is the second reference number or more or in a case in which the proportion of abnormal dischargers D-F is the second reference value or more.

Further, in a case in which the determination result of Step S70 is negative, the controller 6 of the ink jet printer 1 allows a supplementary printing process to continue by advancing the process to Step S60.

Further, after the Step S80, the controller 6 of the ink jet printer 1 determines whether or not the printing process based on the printing data Img is finished (S90). Further, the ink jet printer 1 finishes the process shown by FIG. 6 in a case in which the determination result of Step S90 is affirmative, and advances the process to Step S10 in a case in which the determination result of Step S90 is negative.

4. Configuration of Head Units

Hereinafter, a configuration of each head unit HU will be described with reference to FIG. 7.

Figure 7:
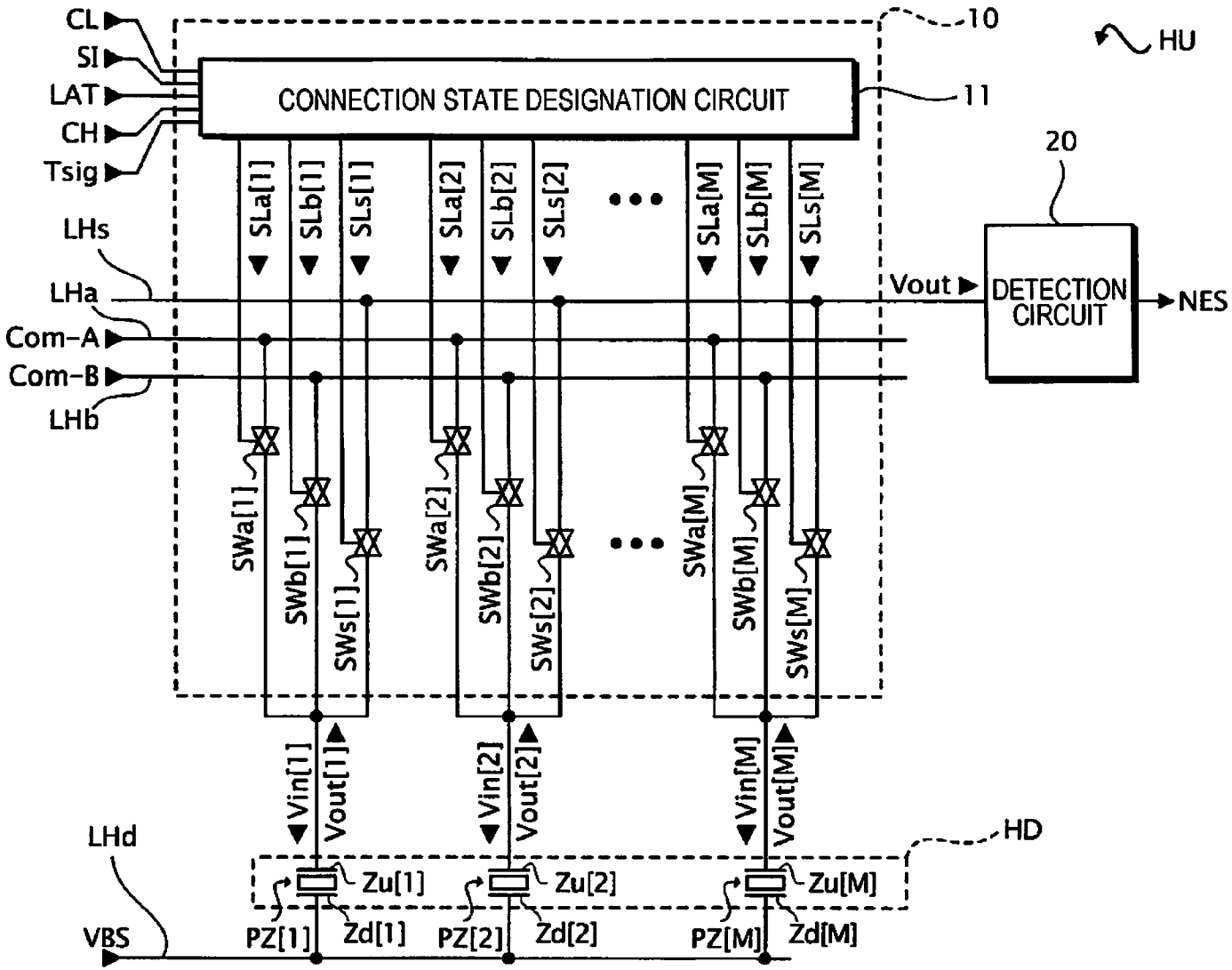
FIG. 7 is a block diagram that shows a configuration of a head unit.

FIG. 7 is a block diagram that shows an example of a configuration of a head unit HU. In the above-mentioned manner, the head unit HU is provided with the recording head HD, the switching circuit 10, and the detection circuit 20. In addition, the head unit HU is provided with inner portion wiring LHa to which the driving signal Com-A is supplied from the driving signal generation circuit 2, inner portion wiring LHb to which the driving signal Com-B is supplied from the driving signal generation circuit 2, and inner portion wiring LHs for supplying detection signals Vout, which are detected from the dischargers D, to the detection circuit 20.

As shown in FIG. 7, the switching circuit 10 is provided with M switches SWa (SWa[1] to SWa[M]), M switches SWb (SWb[1] to SWb[M]), M switches SWs (SWs[1] to SWs[M]), and a connection state designation circuit 11 that designates the connection state of each switch. Additionally, for example, it is possible to adopt a transmission gate as each switch.

The connection state designation circuit 11 generates connection state designation signals SLa[1] to SLa[M] that designate either on or off for the switches SWa[1] to SWa[M], connection state designation signals SLb[1] to SLb[M] that designate either on or off for the switches SWb[1] to SWb[M], and connection state designation signals SLs[1] to SLs[M] that designate either on or off for the switches SWs[1] to SWa[M] on the basis of at least a portion of signals of the printing signal SI, a latch signal LAT, a change signal CH and a period designation signal Tsig, which are supplied from the controller 6.

A switch SWa[m] switches between conduction and non-conduction of the inner portion wiring LHa and an upper portion electrode Zu[m] of a piezoelectric element PZ[m] provided in a discharger D[m] in accordance with a connection state designation signal SLa[m]. For example, a switch Swa[m] is turned on in a case in which a connection state designation signal SLa[m] is at a high level, and is turned off in a case in which the connection state designation signal SLa[m] is at a low level.

A switch SWb[m] switches between conduction and non-conduction of the inner portion wiring LHb and an upper portion electrode Zu[m] of a piezoelectric element PZ[m] provided in a discharger DM in accordance with a connection state designation signal SLbD[m]. For example, a switch Swb[m] is turned on in a case in which a connection state designation signal SLb[m] is at a high level, and is turned off in a case in which the connection state designation signal SLb(m) is at a low level.

Additionally, among the driving signals Com-A and Com-B, there are cases in which a signal supplied in a practical sense to a piezoelectric element PZ[m] of a discharger D[m] via either a switch SWa[m] or a switch SWb[m] is referred to as a supplied driving signal Vin[m].

A switch SLs[m] switches between conduction and non-conduction of the inner portion wiring LHs and an upper portion electrode Zu[m] of a piezoelectric element PZ [m] provided in a discharger D[m] in accordance with a connection state designation signal SLs[m]. For example, a switch Sws[m] is turned on in a case in which a connection state designation signal SLs[m] is at a high level, and is turned off in a case in which the connection state designation signal SLs(m) is at a low level.

A detection signal Vout[m] output from a piezoelectric element PZ[m] of a discharger D[m] driven as a determination target discharger D-H is supplied to the detection circuit 20 via the inner portion wiring LHs. Further, the detection circuit 20 generates a residual vibration signal NES on the basis of the detection signal Vout[m].

5. Operations of Head Units

Hereinafter, operations of each head unit HU will be described with reference to FIGS. 8 to 11.

In the present embodiment, an operation period of the ink jet printer 1 includes a single or a plurality of unit periods Tu. A case in which the ink jet printer 1 according to the present embodiment executes either driving of each discharger D in a printing process, or driving of a determination target discharger D-H and detection of residual vibrations in a discharge state determination process in each unit period Tu is assumed. However, the invention is not limited to such an aspect, and it is also possible to execute both driving of each discharger D in a printing process, and driving of a determination target discharger D-H and detection of residual vibrations in a discharge state determination process in each unit period Tu.

Additionally, generally, the ink jet printer 1 forms an image that the printing data Img shows by causing the ink to be discharged from each discharger D a single or a plurality of times as a result of repeatedly executing a printing process over the course of a plurality of unit periods Tu in either a continuous or intermittent manner. In addition, the ink jet printer 1 according to the present embodiment executes a discharge state determination processes in which each of M dischargers D[1] to D[M] is set as the determination target discharger D-H by executing M discharge state determination processes in M unit periods Tu provided in either a continuous or intermittent manner.

Figure 8:
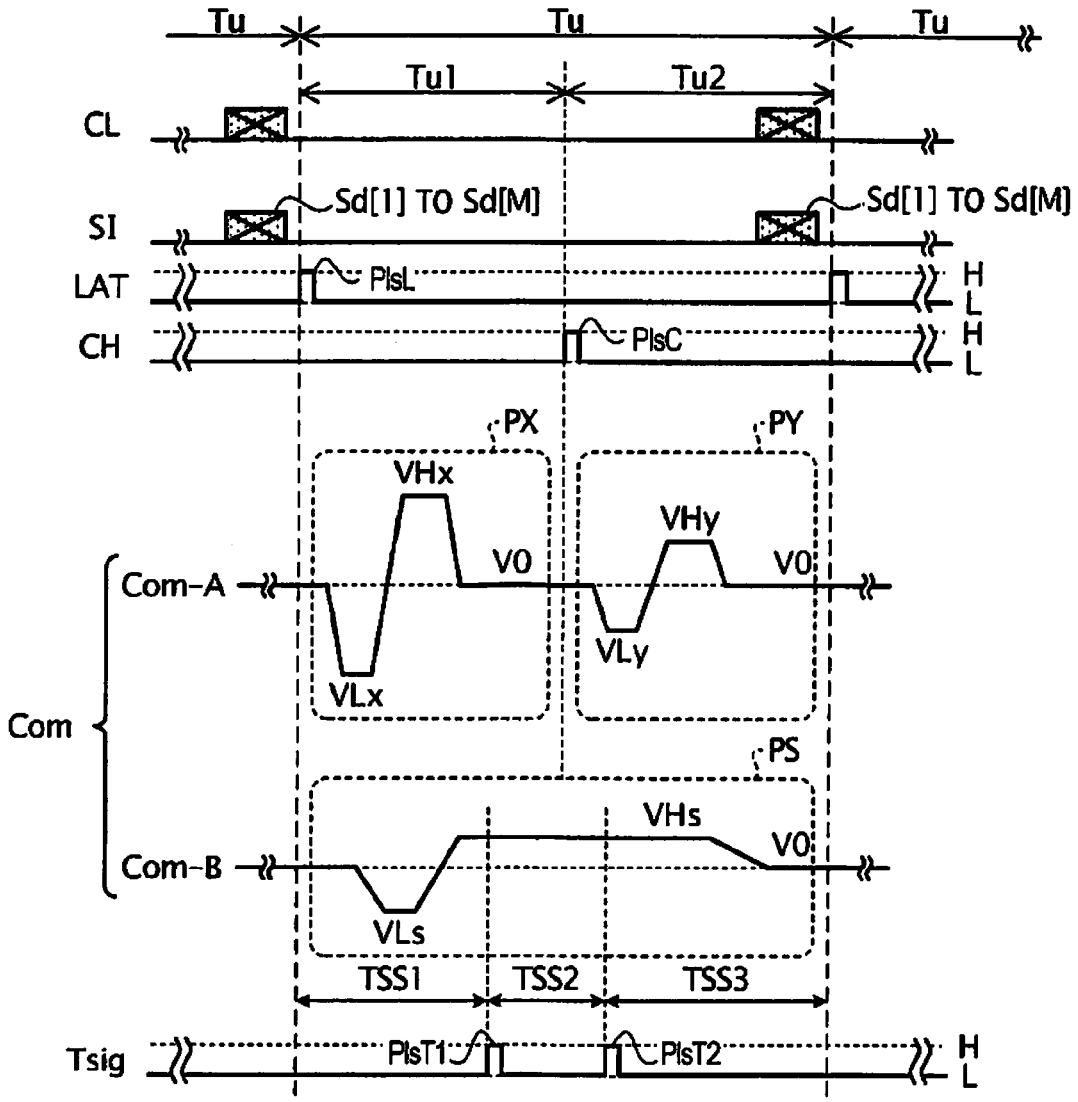
FIG. 8 is a timing chart for describing a printing process and a discharge state determination process.

FIG. 8 is a timing chart for describing operations in a unit period Tu of the ink jet printer 1.

As shown in FIG. 8, the controller 6 outputs the latch signal LAT, which includes a pulse PlsL, and the change signal CH, which includes a pulse PlsC. As a result of this, the controller 6 stipulates the unit period Tu as a period from a rise in the pulse PlsL until a subsequent rise in the pulse PlsL. In addition, the controller 6 divides the unit period Tu into two control periods Tu1 and Tu2 by using the pulse PlsC.

The printing signal SI includes individual designation signals Sd[1] to Sd[m] that designate the mode of driving of the dischargers D[1] to D[M] on each unit period Tu. Further, in a case in which at least one of a printing process and a discharge state determination process is being executed in the unit period Tu, as shown in FIG. 8, the driving controller 61 of the controller 6 supplies the printing signal SI including the individual designation signals Sd[1] to Sd[M] to the connection state designation circuit 11 in synchronization with a clock signal CL prior to the initiation of the unit period Tu. In this case, the connection state designation circuit 11 generates connection state designation signals SLa[m], SLb[m], and SLs[m] on the basis of an individual designation signal Sd[m] in the unit period Tu.

Additionally, an individual designation signal Sd[m] according to the present embodiment is a signal that designates any one driving aspect of five driving aspects of the discharge of ink of an amount (a large amount) that is equivalent to a large dot (referred to as "formation of a large dot" in some cases), the discharge of ink of an amount (a medium amount) that is equivalent to a medium dot (referred to as "formation of a medium dot" in some cases), the discharge of ink of an amount (a small amount) that is equivalent to a small dot (referred to as "formation of a small dot" in some cases), non-discharge of ink, and driving as a determination target in a discharge state determination process (referred to as "driving as a determination target discharger D-H" in some cases), for a discharger D[m] in each unit period Tu. Additionally, in the present embodiment, as one example, a case in which an individual designation signal Sd[m] is a 3-bit digital signal is assumed (refer to FIG. 11).

As shown in FIG. 8, the driving signal generation circuit 2 outputs the driving signal Com-A, which includes a waveform PX provided in the control period Tu1, and a waveform PY provided in the control period Tu2. In the present embodiment, the waveform PX and the waveform PY are established so that a difference in potential between a highest potential VHX and a lowest potential VLX of the waveform PX is greater than a difference in potential between a highest potential VHY and a lowest potential VLY of the waveform PY. More specifically, the waveform of the waveform PX is established so that a medium amount of the ink is discharged from a discharger D[m] in a case in which the discharger D[m] is driven by a driving signal Com-A including the waveform PX. In addition, the waveform of the waveform PY is established so that a small amount of the ink is discharged from a discharger D[m] in a case in which the discharger D[m] is driven by a driving signal Com-A including the waveform PY. Additionally, in the waveform PX and the waveform PY, the potentials during initiation and during termination are set to be a reference potential V0.

Further, in a case in which an individual designation signal Sd[m] designates the formation of a large dot for a discharger D[m], the connection state designation circuit 11 sets a connection state designation signal SLa[m] to a high level in the control periods Tu1 and Tu2, and sets connection state designation signals SLb[m] and SLa[m] to a low level in the unit period Tu. In this case, the discharger D[m] discharges a medium amount of the ink as a result of being driven by a driving signal Com-A having the waveform PX in the control period Tu1, and discharges a small amount of the ink as a result of being driven by a driving signal Com-A having the waveform PY in the control period Tu2. As a result of this, in the unit period Tu, in total, the discharger D[m] discharges a large amount of the ink, and a large dot is formed on a recording sheet P.

In addition, in a case in which an individual designation signal Sd[m] designates the formation of a medium dot for a discharger D[m], the connection state designation circuit 11 sets a connection state designation signal SLa[m] to a high level in the control period Tu1 and a low level in the control periods Tu2, and respectively sets connection state designation signals SLb[m] and SLs[m] to a low level in the unit period Tu. In this case, in the unit period Tu, the discharger D[m] discharges a medium amount of the ink, and a medium dot is formed on a recording sheet P.

In addition, in a case in which an individual designation signal Sd[m] designates the formation of a small dot for a discharger D[m], the connection state designation circuit 11 sets a connection state designation signal SLa[m] to a low level in the control period Tu1 and a high level in the control periods Tu2, and respectively sets connection state designation signals SLb[m] and SLb[m] to a low level in the unit period Tu. In this case, in the unit period Tu, the discharger D[m] discharges a small amount of the ink, and a small dot is formed on a recording sheet P.

In addition, in a case in which an individual designation signal Sd[m] designates non-discharge of the ink for a discharger D[m], the connection state designation circuit 11 sets connection state designation signals SLb[m], SLb[m], and SLs[m] to a low level in the unit period Tu. In this case, in the unit period Tu, a discharger D[m] does not discharge the ink, and a dot is not formed on a recording sheet P.

As shown in FIG. 8, the driving signal generation circuit 2 outputs the driving signal Com-B, which includes a waveform PS provided in the unit period Tu. In the present embodiment, the waveform PS is established so that a difference in potential between a highest potential VHS and a lowest potential VLS of the waveform PS is smaller than a difference in potential between the highest potential VHY and the lowest potential VLY of the waveform PY. More specifically, the waveform of the waveform PS is established so that a discharger D[m] is driven by an extent at which the ink is not discharged from the discharger D[m] in a case in which the driving signal Com-B including the waveform PS is supplied to the discharger D[m]. Additionally, in the waveform PS, the potentials during initiation and during termination are set to be the reference potential V0.

In addition, the controller 6 outputs the period designation signal Tsig, which includes a pulse PlsT1 and a pulse PlsT2. As a result of this, the controller 6 divides the unit period Tu into a control period TSS1 from the initiation of the pulse PlsL until the initiation of the pulse PlsT1, a control period TSS2 from the initiation of the pulse PlsT1 until the initiation of the pulse PlsT2, and a control period TSS3 from the initiation of the pulse PlsT2 until the initiation of a subsequent pulse PlsL.

Further, in a case in which an individual designation signal Sd[m] designates a discharger DM as a determination target discharger D-H, the connection state designation circuit 11 sets a connection state designation signal SLa[m] to a low level in the unit period Tu, respectively sets a connection state designation signal SLb[m] to a high level in the control periods TSS1 and TSS3 and to a low level in the control period TSS2, and respectively sets a connection state designation signal SLs[m] to a low level in the control periods TSS1 and TSS3 and to a high level in the control period TSS2.

In this case, the determination target discharger D-H is driven by a driving signal Com-B having the waveform PS in the control period TSS1. More specifically, the piezoelectric element PZ that the determination target discharger D-H includes is displaced by the driving signal Com-B having the waveform PS in the control period TSS1. As a result of this, vibrations occur in the determination target discharger D-H, and the vibrations also remain in the control period TSS2. Further, in the control period TSS2, the upper portion electrode Zu that the piezoelectric element PZ of the determination target discharger D-H includes causes the potential to change accordance with the residual vibrations that occur in the determination target discharger D-H. In other words, the control period TSS2, in the upper portion electrode Zu that the piezoelectric element PZ of the determination target discharger D-H includes shows a potential that depends on the electromotive force of the piezoelectric element PZ caused by residual vibrations that occur in the determination target discharger D-H. Further, it is possible to detect the potential of the upper portion electrode Zu as the detection signal Vout in the control period TSS2.

Figure 9:
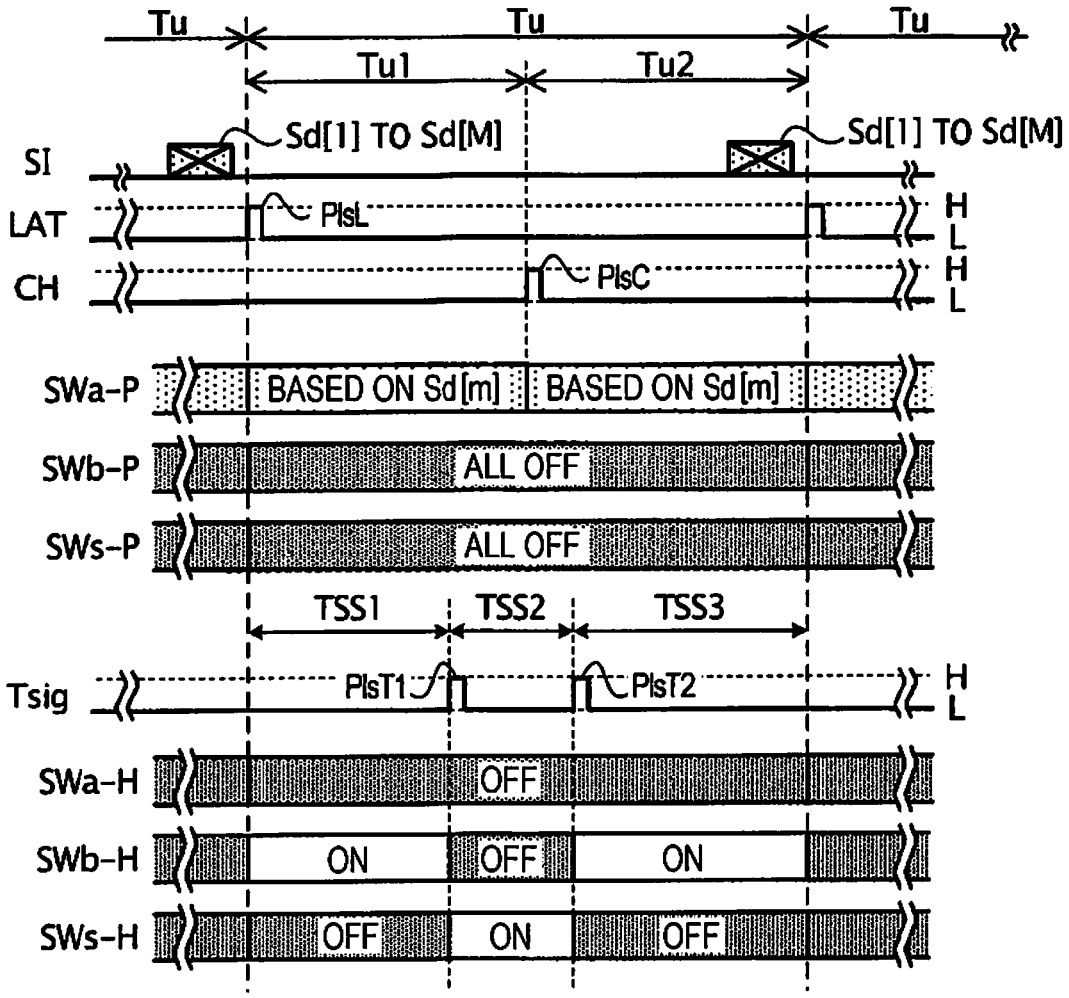
FIG. 9 is a timing chart for describing a printing process and a discharge state determination process.

FIG. 9 is an explanatory view for describing operations of the switching circuit 10 in the unit period Tu. Additionally, hereinafter, there are cases in which the switches SWa, SWb, and SWs provided to correspond to a determination target discharger D-H will respectively be referred to as switches SWa-H, SWb-H, and SWs-H. In addition, hereinafter, there are cases in which a discharger D driven in a printing process will be referred to as a printing driving discharger D-P, and in which the switches SWa, SWb, and SWs provided to correspond to a printing driving discharger D-P will respectively be referred to as switches SWa-P, SWb-P, and SWs-P.

As shown in FIG. 9, in a case in which a discharger D[m] is operated as a printing driving discharger D-P in the unit period Tu, the discharger D[m] is driven in accordance with an individual designation signal Sd[m], and is used in printing.

As shown in FIG. 9, in a case in which a discharger D[m] is operated as a determination target discharger D-H in the unit period Tu, a switch SWa[m], which is the switch SWa-H, is turned off throughout the unit period Tu, a switch SWb[m], which is the switch SWb-H, is turned on in the control period TSS1 and the control period TSS3, and a switch SWs[m], which is the switch SWs-H, is turned on in the control period TSS2. In this case, a piezoelectric element PZ[m] that the discharger D[m], which is the determination target discharger D-H, includes is displaced as a result of being driven by the driving signal Com-B in the control period TSS1, and a state in which residual vibrations occur in the discharger D is created in the control period TSS2. Further, in the control period TSS2, a detection signal Vout[m] based on the residual vibrations in the discharger D[m] is supplied to the detection circuit 20 via the inner portion wiring LHs.

Figure 10:
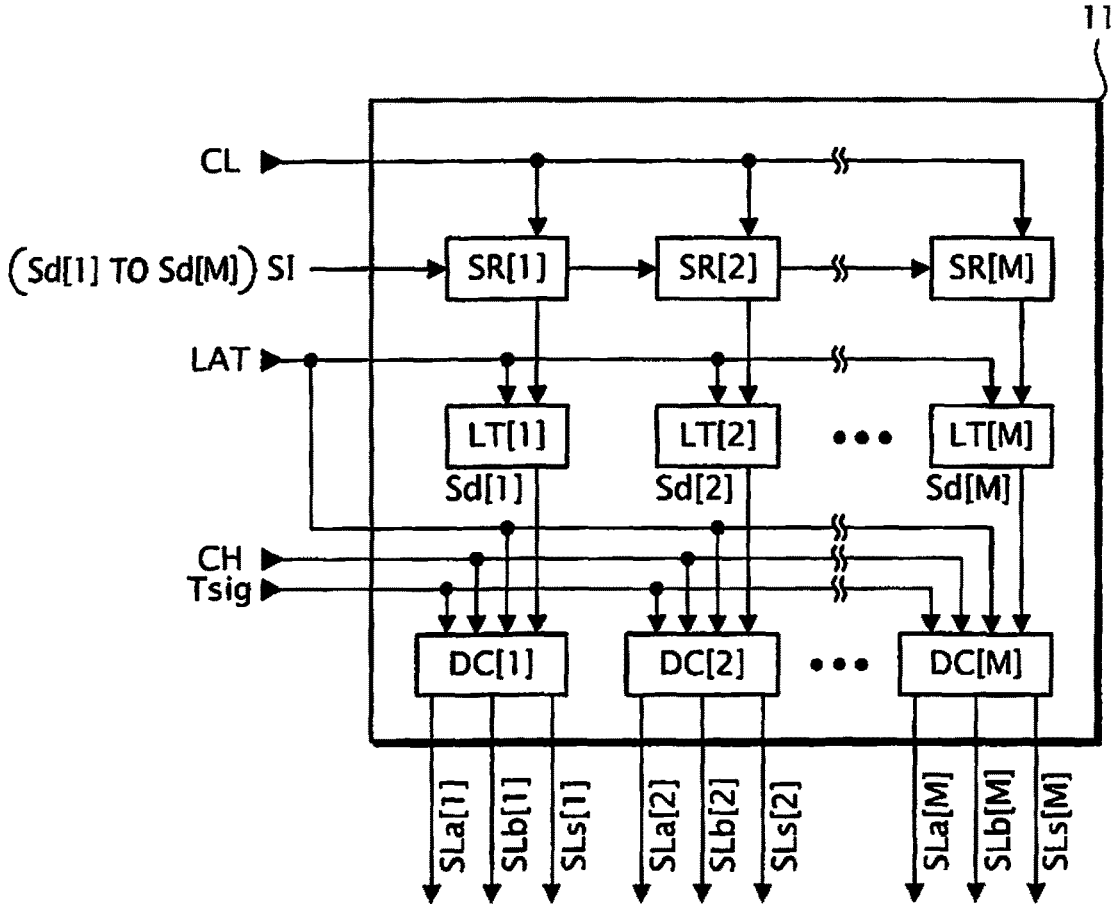
FIG. 10 is a block diagram that shows a configuration of a connection state designation circuit.

FIG. 10 is a view that shows an example of a configuration of the connection state designation circuit 11 according to the present embodiment. As shown in FIG. 10, the connection state designation circuit 11 generates the connection state designation signals SLa[1] to SLa[M], SLb [1] to SLb[M], and SLs [1] to SLs[M].

More specifically, the connection state designation circuit 11 includes transmission circuits SR[1] to SR[M], latch circuits LT[1] to LT[M], and decoders DC[1] to DC[M] so as to correspond to the dischargers D[1] to D[M] on a one-to-one basis. Among these, an individual designation signal Sd[m] is supplied to a transmission circuit SR[m]. Additionally, in the drawing, a case in which the individual designation signals Sd[1] to Sd[M] are supplied in serial, and for example, an individual designation signal Sd[m] that corresponds to an $m^{th}$ stage is transmitted in order from the transmission circuits SR[1] to a transmission circuit SR[m] in synchronization with the clock signal CL, is illustrated by way of example. In addition, a latch circuit LT[m] latches an individual designation signal Sd[m] supplied to a transmission circuit SR[m] at a timing at which the pulse PlsL of the latch signal LAT rises to a high level. In addition, a decoder DC[m] generates connection state designation signals SLa [m], SLb[m], and SLs[m] on the basis of an individual designation signal Sd[m], the latch signal LAT, the change signal CH, and the period designation signal Tsig.

FIG. 11 is an explanatory view for describing the generation of connection state designation signals SLa[m], SLb[m], and SLs [m] in a decoder DC[m]. A decoder DC [m] generates connection state designation signals SLa[m], SLb[m], and SLs[m] by decoding an individual designation signal Sd[m] in accordance with FIG. 11.

As shown in FIG. 11, an individual designation signal Sd[m] according to the present embodiment shows a value of any one of a value (1, 1, 0) that designates the formation of a large dot, a value (1, 0, 0) that designates the formation of a medium dot, a value (0, 1, 0) that designates the formation of a small dot, a value (0, 0, 0) that designates non-discharge of the ink, and a value (1, 1, 1) that designates driving as a determination target discharger D-H. Further, a decoder DC[m] sets a connection state designation signal SLa[m] to a high level in the control periods Tu1 and Tu2 in a case in which an individual designation signal Sd[m] shows (1, 1, 0), sets a connection state designation signal SLa[m] to a high level in the control period Tu1 in a case in which an individual designation signal Sd[m] shows (1, 0, 0), sets a connection state designation signal SLa[m] to a high level in the control period Tu2 in a case in which an individual designation signal Sd[m] shows (0, 1, 0), sets a connection state designation signal SLb[m] to a high level in the control periods TSS1 and TSS3 and sets a connection state designation signal SLs[m] to a high level in the control period TSS2 in a case in which an individual designation signal Sd[m] shows (1, 1, 1), and sets each signal to a low level in case that do not correspond to those above.

In the above-mentioned manner, the detection circuit 20 generates the residual vibration signal NES on the basis of the detection signal Vout. The residual vibration signal NES is a signal according to which the detection signal Vout is shaped into a waveform that is suited to the processes in the discharge state determination circuits 9 by amplifying the amplitude of the detection signal Vout, and removing a noise component from the detection signal Vout.

For example, the detection circuit 20 may have a configuration that includes a negative feedback type amplifier for amplifying the detection signal Vout, a low-pass filter for dampening a high frequency component of the detection signal Vout, and a voltage follower that outputs a low impedance residual vibration signal NES by converting the impedance thereof, or the like.

6. Discharge State Determination Circuit

Next, a discharge state determination circuit 9 will be described.

Generally, the residual vibrations that occur in the dischargers D have natural vibration frequency that is established by the shape of the nozzles N, the weight of the ink with which the cavities 320 are filled, the viscosity of the ink with which the cavities 320 are filled, and the like.

In addition, generally, in a case in which a discharge abnormality has occurred in a discharger D due to an air bubble being incorporated in the cavity 320 of the discharger D, the frequency of the residual vibrations is higher than a case in which an air bubble is not incorporated in the cavity 320. In addition, generally, in a case in which a discharge abnormality has occurred in a discharger D due to foreign matter such as paper debris being adhered to the vicinity of the nozzle N of the discharger D, the frequency of the residual vibrations is lower than a case in which foreign matter is not adhered thereto. In addition, generally, in a case in which a discharge abnormality has occurred in a discharger D due to the ink with which the cavity 320 of the discharger D is filled thickening, the frequency of the residual vibrations is lower than a case in which the ink has not thickened. In addition, generally, in a case in which a discharge abnormality has occurred in a discharger D due to the ink with which the cavity 320 of the discharger D is filled thickening, the frequency of the residual vibrations is lower than a case in which foreign matter such as paper debris is adhered to the vicinity of the nozzle N of the discharger D. In addition, generally, in a case in which a discharge abnormality has occurred in a discharger D due to the cavity 320 of the discharger D not being filled with the ink, or in a case in which a discharge abnormality has occurred in a discharger D due to the piezoelectric element PZ not being displaced as a result of being broken, the amplitude of the residual vibrations is low.

In the above-mentioned manner, the residual vibration signal NES shows a waveform that depends on the residual vibrations that occur in a determination target discharger D-H. More specifically, the residual vibration signal NES shows a frequency that depends on the frequency of the residual vibrations that occur in a determination target discharger D-H, and shows a frequency that depends on the amplitude of the residual vibrations that occur in a determination target discharger D-H. Therefore, the discharge state determination circuit 9 can perform discharge state determination that determines the discharge state of the ink in a determination target discharger D-H on the basis of the residual vibration signal NES.

In the discharge state determination, the discharge state determination circuit 9 measures a duration NTc of a single period of the residual vibration signal NES, and generates period information Info-T that shows the measurement result.

In addition, in the discharge state determination, the discharge state determination circuit 9 generates amplitude information Info-S that shows whether or not the residual vibration signal NES has a predetermined amplitude. More specifically, the discharge state determination circuit 9 determines whether or not the potential of the residual vibration signal NES becomes a threshold value potential Vth-C, which is a higher potential than a potential Vth-C of a center level of the amplitude of the residual vibration signal NES, or more, or becomes a threshold value potential Vth-U, which is a lower potential than the potential Vth-C, or less in the period for which the duration NTc of a single period of the residual vibration signal NES is measured. Further, in a case in which the result of the determination is affirmative, the amplitude information Info-S is set to a value, for example, "1", that shows that the residual vibration signal NES has a predetermined amplitude, and in a case in which the result of the determination is negative, the amplitude information Info-S is set to a value, for example, "0", that shows that the residual vibration signal NES does not have a predetermined amplitude.

Further, the discharge state determination circuit 9 generates determination information Stt that shows the determination result of the discharge state of the ink in a determination target discharger D-H on the basis of the period information Info-T and the amplitude information Info-S.

FIG. 12 is an explanatory view for describing the generation of determination information Stt in a discharge state determination circuit 9.

As shown in the drawing, the discharge state determination circuit 9 determines the discharge state in a determination target discharger D-H by comparing the duration NTc that the period information Info-T shows with one or all of a threshold value Tth1, a threshold value Tth2, and a threshold value Tth3, and generates determination information Stt that shows the result of the determination.

In this instance, the threshold value Tth1 is a value for showing a boundary between the duration of a single period of residual vibrations in a case in which the discharge state of a determination target discharger D-H is normal, and the duration of a single period of residual vibrations in a case in which an air bubble is incorporated in the cavity 320. In addition, the threshold value Tth2 is a value for showing a boundary between the duration of a single period of residual vibrations in a case in which the discharge state of a determination target discharger D-H is normal, and the duration of a single period of residual vibrations in a case in which foreign matter is adhered to the vicinity of the nozzle N. In addition, the threshold value Tth3 is a value for showing a boundary between the duration of a single period of residual vibrations in a case in which foreign matter is adhered to the vicinity of the nozzle N of a determination target discharger D-H, and the duration of a single period of residual vibrations in a case in which the ink inside the cavity 320 has thickened. Additionally, the threshold values Tth1 to the threshold value Tth3 satisfy "Tth1<Tth2<Tth3".

As shown in FIG. 12, in the present embodiment, it is deemed that the discharge state of the ink in a determination target discharger D-H is normal in a case in which the value of the amplitude information Info-S is "1" and the duration NTc that the period information Info-T shows satisfies "Tth1≤NTc≤Tth2". Further, in this case, the discharge state determination circuit 9 sets a value "1", which shows that the discharge state of a determination target discharger D-H is normal, as the determination information Stt.

In addition, it is deemed that a discharge abnormality due to an air bubble has occurred in a determination target discharger D-H in a case in which the value of the amplitude information Info-S is "1" and the duration NTc that the period information Info-T shows satisfies "NTc<Tth1". Further, in this case, the discharge state determination circuit 9 sets a value "2", which shows that a discharge abnormality due to an air bubble has occurred in a determination target discharger D-H, as the determination information Stt.

In addition, it is deemed that a discharge abnormality due to the adherence of foreign matter has occurred in a determination target discharger D-H in a case in which the value of the amplitude information Info-S is "1" and the duration NTc that the period information Info-T shows satisfies "Tth2<NTc≤Tth3". Further, in this case, the discharge state determination circuit 9 sets a value "3", which shows that a discharge abnormality due to the adherence of foreign matter has occurred in a determination target discharger D-H, as the determination information Stt.

In addition, it is deemed that a discharge abnormality due to thickening has occurred in a determination target discharger D-H in a case in which the value of the amplitude information Info-S is "1" and the duration NTc that the period information Info-T shows satisfies "Tth3<NTc". Further, in this case, the discharge state determination circuit 9 sets a value "4", which shows that a discharge abnormality due to thickening has occurred in a determination target discharger D-H, as the determination information Stt.

In addition, it is deemed that a discharge abnormality has occurred in a determination target discharger D-H in a case in which the value of the amplitude information Info-S is "0". Further, in this case, the discharge state determination circuit 9 sets a value "5", which shows that a discharge abnormality has occurred in a determination target discharger D-H, as the determination information Stt.

In the above-mentioned manner, the discharge state determination circuit 9 generates the determination information Stt on the basis of the period information Info-T and the amplitude information Info-S.

Further, the controller 6 causes the determination information Stt that the discharge state determination circuit 9 generates to be stored in the storage portion 5 in association with a stage number m of a determination target discharger D-H that corresponds to the determination information Stt. As a result of this, the controller 6 manages items of determination information Stt[1] to Stt[M] that correspond to the dischargers D[1] to D[M].

Additionally, in the present embodiment, a case in which the determination information Stt is information of five values from "1" to "5" is illustrated by way of example, but the determination information Stt may be information of two values that show whether or not the duration NTc satisfies "Tth1≤NTc≤Tth2". It is sufficient as long as the determination information Stt may include at least information that shows whether or not the discharge state of the ink in a determination target discharger D-H is normal.

7. Normal Printing Process and Supplementary Printing Process

Hereinafter, a supplementary printing process will be described with reference to FIGS. 13 to 16.

Figure 13:
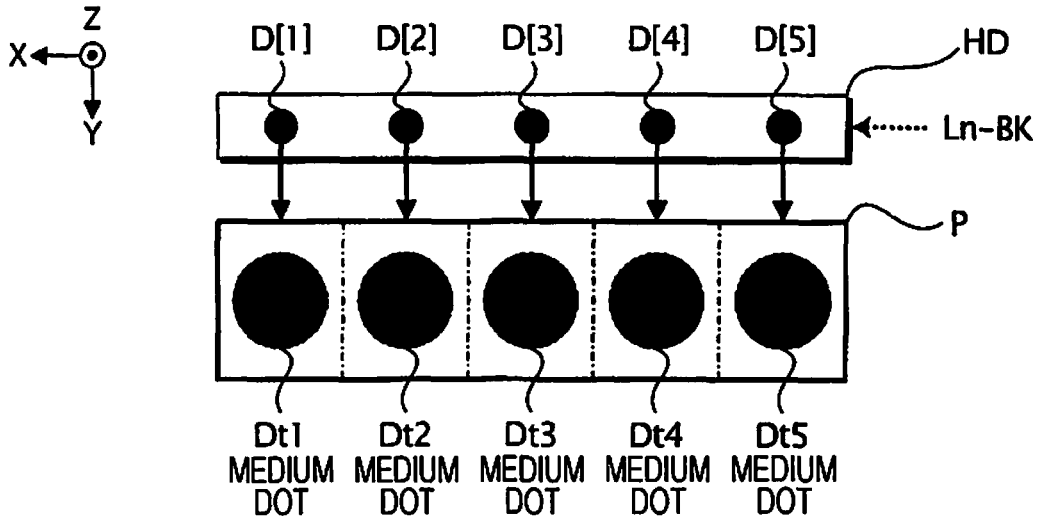
FIG. 13 is an explanatory view for describing a normal printing process.

In FIG. 13, a case in which a normal printing process is executed and five medium dots Dt1 to Dt5 are formed by five dischargers D[1] to D[5] having nozzles N that belong to a nozzle row Ln-BK in a case in which the discharge states of the five dischargers D[1] to D[5] are normal is illustrated by way of example.

Figure 14:
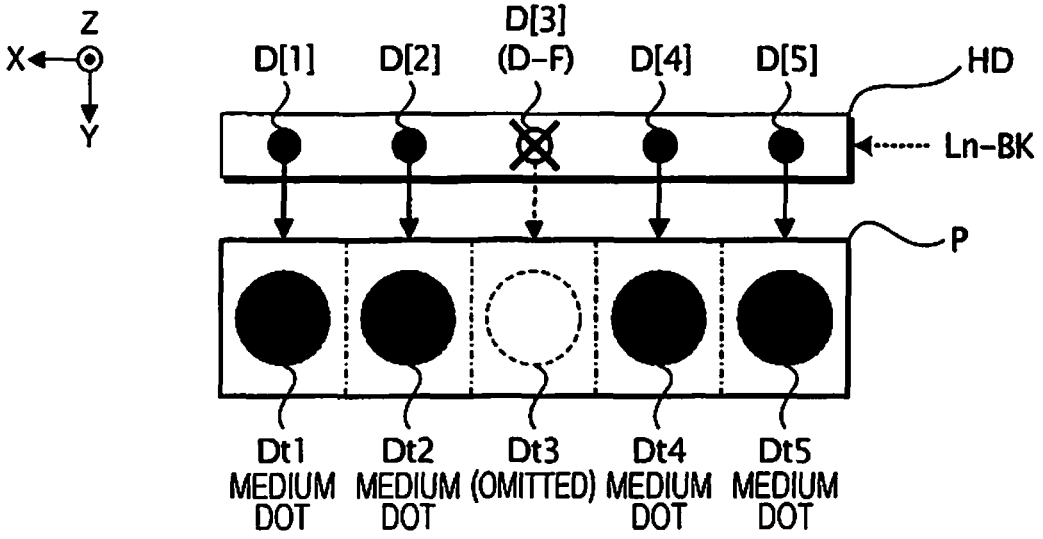
FIG. 14 is an explanatory view for describing a discharge abnormality.

In FIG. 14, a case in which a normal printing process such as that illustrated by way of example in FIG. 13 is executed, and although an attempt is made to form the five medium dots Dt1 to Dt5 using the five dischargers D[1] to D[5], the discharger D[3] is an abnormal discharger D-F, discharge of the ink from the discharger D[3] fails, and the medium dot Dt3 expected to be formed by the ink discharged from the discharger D[3] is not formed is illustrated by way of example.

Figure 15:
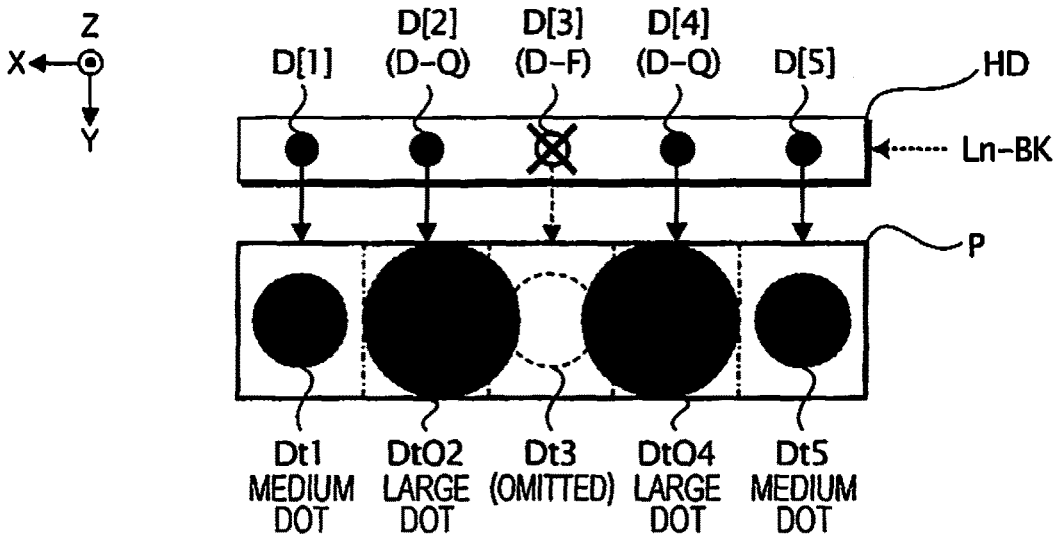
FIG. 15 is an explanatory view for describing a supplementary printing process.

FIG. 15 illustrates a case in which a supplementary printing process is executed instead of a normal printing process in the example shown in FIG. 14 by way of example. More specifically, in the supplementary printing process shown in FIG. 15, the discharger D[2] and the discharger D[4], which are dischargers D that have nozzles N belonging to the same nozzle row Ln as the abnormal discharger D-F and are adjacent to the abnormal discharger D-F, are adopted as supplementary dischargers D-Q that supplement the discharger D[3], which is the abnormal discharger D-F. In other words, in the supplementary printing process illustrated by way of example in FIG. 15, dischargers D that are adjacent to the abnormal discharger D-F in the sub-scanning direction (the X axis direction in the present embodiment) are adopted as supplementary dischargers D-Q. Further, in the supplementary printing process shown in FIG. 15, in comparison with the normal printing process shown in FIG. 14, the discharge amounts of the ink from the discharger D[2] and the discharger D[4], which are the supplementary dischargers D-Q, is increased, and driving of the discharger D[3] is caused to stop as a result of stopping the supply of the driving signal Com to the discharger D[3], which is the abnormal discharger D-F. As a result of this, in the supplementary printing process shown in FIG. 15, a large dot DtQ2 and a large dot DtQ4 are formed instead of the medium dot Dt2 and the medium dot Dt4 formed in the normal printing process shown in FIG. 14. Therefore, in the supplementary printing process shown in FIG. 15, in comparison with the normal printing process shown in FIG. 14, even in a case in which dot omission occurs as a result of the formation of the dot Dt3 failing, it is possible to form dots Dt having an appearance that is similar to that of the original plurality of dots Dt to be formed that are shown in FIG. 13, and therefore, it is possible to reduce the extent of a deterioration in image quality that accompanies a discharge abnormality.

Additionally, in the supplementary printing process shown in FIG. 15, a case in which the nozzle N of the abnormal discharger D-F and the nozzles N of the supplementary dischargers D-Q belong to a nozzle row Ln-BK is illustrated by way of example, but this is merely one example, and the nozzle N of the abnormal discharger D-F and the nozzles N of the supplementary dischargers D-Q may belong to a nozzle row Ln other than a nozzle row Ln-BK.

In addition, in the supplementary printing process shown in FIG. 15, two dischargers D that are dischargers D having nozzles N belonging to the same nozzle row Ln as the abnormal discharger D-F and are adjacent to the abnormal discharger D-F are adopted as supplementary dischargers D-Q, but the invention is not limited to such an aspect, and there may be a single supplementary discharger D-Q, or a supplementary discharger D-Q may be a discharger D having nozzles N belonging to a different nozzle row Ln than the abnormal discharger D-F.

Figure 16:
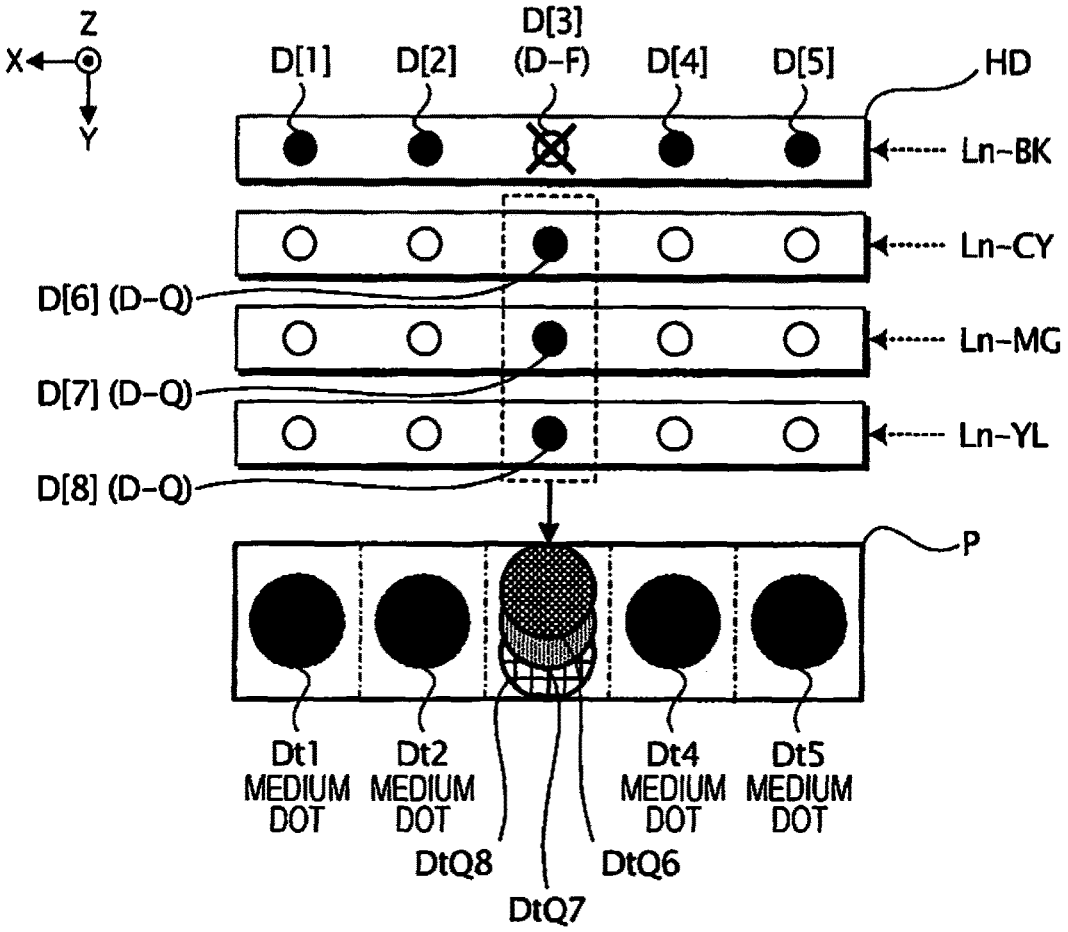
FIG. 16 is an explanatory view for describing a supplementary printing process.

FIG. 16 illustrates a case in which a supplementary printing process is executed instead of a normal printing process in the example shown in FIG. 14 by way of example. More specifically, in a supplementary printing process shown in FIG. 16, a case in which a discharger D[6] that corresponds to a nozzle row Ln-CY, a discharger D[7] that corresponds to a nozzle row Ln-MG, and a discharger D[8] that corresponds to a nozzle row Ln-YL, which are dischargers D that have nozzles N belonging to different nozzle rows Ln than the abnormal discharger D-F, are adopted as supplementary dischargers D-Q that supplement the discharger D[3], which corresponds to the nozzle row Ln-BK and is the abnormal discharger D-F is illustrated by way of example. In other words, in the supplementary printing process illustrated by way of example in FIG. 16, dischargers D that are positioned in the main scanning direction or the direction opposite thereto (the Y axis direction in the present embodiment) when viewed from the abnormal discharger D-F are adopted as supplementary dischargers D-Q. Further, in the supplementary printing process shown in FIG. 16, in comparison with the normal printing process shown in FIG. 14, the discharge amounts of the ink from the discharger D[6], the discharger D[7], and the discharger D[8], which are the supplementary dischargers D-Q, is increased, and driving of the discharger D[3] is caused to stop as a result of stopping the supply of the driving signal Com to the discharger D[3], which is the abnormal discharger D-F. As a result of this, in the supplementary printing process shown in FIG. 16, a medium dot DtQ6 formed by cyan ink, a medium dot DtQ7 formed by magenta ink, and a medium dot DtQ8 formed by yellow ink are formed instead of the original medium dot Dt3 to be formed by black ink. Therefore, in the supplementary printing process shown in FIG. 16, in comparison with the normal printing process shown in FIG. 14, even in a case in which formation of the dot Dt3 fails, it is possible to form a dot Dt having an appearance that is similar to that of the original dot Dt to be formed that are shown in FIG. 13, and therefore, it is possible to reduce the extent of a deterioration in image quality that accompanies a discharge abnormality.

8. Conclusion of Embodiment

In the manner described above, according to the present embodiment, even in a case in which there is a discharger D having a discharge abnormality, since it is possible to execute a supplementary printing process, it is possible to improve the convenience of the ink jet printer 1 for a user in comparison with a case in which a maintenance process is executed immediately after the detection of a discharge abnormality without executing a supplementary printing process.

In addition, according to the present embodiment, in a case in which there is a discharger D having a discharge abnormality, since the time during which a supplementary printing process is executed is restricted to a predetermined time or less, for example, it is possible to prevent the occurrence of severe discharge abnormalities that cannot be repaired even if a maintenance process is used, such as the ink becoming fixed as a result of the extent of the thickening of the ink worsening in a discharger D in which a discharge abnormality has occurred due to thickening of the ink.

B. Modification Examples

Each of the abovementioned aspects can be modified in a variety of ways. Aspects of specific modifications are illustrated by way of example below. Two or more aspects chosen arbitrarily from the following examples can be combined as appropriate within a range in which the aspects do not contradict one another. Additionally, in the Modification Examples that are illustrated by way of example below, the reference symbols that are referred to in the abovementioned description are reused for features for which the actions or functions thereof are equivalent to those of the embodiment, and the respective detailed descriptions thereof are omitted as appropriate.

Modification Example 1

In the above-mentioned embodiment, the controller 6 executes a maintenance process in a case in which a predetermined time has elapsed since discharge state determination, but the invention is not limited to such an aspect, and the controller 6 may establish a time from discharge state determination until to the initiation of a maintenance process depending on the process result of a discharge state determination process.

For example, in a case in which an abnormal discharger D-F in which a discharge abnormality caused by thickening of the ink has occurred is detected, the controller 6 may set the time from the discharge state determination until the initiation of a maintenance process to be longer than a case in which only an abnormal discharger D-F in which a discharge abnormality caused by the incorporation of an air bubble has occurred is detected, or a case in which only an abnormal discharger D-F in which a discharge abnormality caused by the adherence of foreign matter has occurred is detected. In addition, for example, in a case in which the number (or ratio) of abnormal dischargers D-F in which a discharge abnormality caused by thickening of the ink has occurred is the first reference number or more (or the first reference value or more), the controller 6 may set the time from the discharge state determination until the initiation of a maintenance process to be longer than a case in which the number (or proportion) of abnormal dischargers D-F in which a discharge abnormality caused by thickening of the ink has occurred is less than the first reference number (or less than the first reference value).

Modification Example 2

In the above-mentioned embodiment and modification examples, the driving signal Com includes the waveform PX and the waveform PY, which are discharge waveforms for driving the dischargers D so as to cause the ink to be discharged from the dischargers D, but the invention is not limited to such an aspect, and the driving signal Com may include a micro vibration waveform PBS, which is a non-discharge waveform for driving the dischargers D by an extent at which the ink is not discharged from the dischargers D.

In this case, the controller 6 (the driving controller 61) according to the present modification example may supply the micro vibration waveform PBS to dischargers D to which the waveform PX and the waveform PY are not supplied in each unit period Tu of a normal printing process. In addition, among dischargers D to which the waveform PX and the waveform PY are not supplied in each unit period Tu of a supplementary printing process, the controller 6 (the driving controller 61) according to the present modification example may supply the micro vibration waveform PBS to dischargers D other than an abnormal discharger D-F. That is, according to the present modification example, it is preferable that the controller 6 (the driving controller 61) control the switching circuit 10 so that none of the waveforms of the waveform PX, the waveform PY, and the micro vibration waveform PBS is supplied to an abnormal discharger D-F in each unit period Tu of a supplementary printing process.

Additionally, the signal among the driving signal Com that includes discharge waveforms such as the waveform PX and the waveform PY is an example of a "first driving signal", and the signal among the driving signal Com that includes a non-discharge waveform such as the micro vibration waveform PBS is an example of a "second driving signal".

Modification Example 3

In the above-mentioned embodiment and modification examples, the controller 6 executes a maintenance process in a case in which a predetermined time has elapsed from the discharge state determination, and in a case in which a time, which depends on the process result of the discharge state determination process, since discharge state determination has elapsed, but the invention is not limited to such an aspect, and the controller 6 may establish a time from discharge state determination until the initiation of a maintenance process depending on whether or not a nozzle N of an abnormal discharger D-F and nozzles N of supplementary dischargers D-Q belong to the same nozzle row Ln.

For example, in a case in which a nozzle N of an abnormal discharger D-F and nozzles N of supplementary dischargers D-Q belong to the same nozzle row Ln, the controller 6 may make the time from discharge state determination until the initiation of a maintenance process shorter than in a case in which a nozzle N of an abnormal discharger D-F and nozzles N of supplementary dischargers D-Q belong to different nozzle rows Ln. According to this aspect, for example, in a case in which a discharge abnormality caused by thickening of the ink has occurred in an abnormal discharger D-F, it is possible to prevent a circumstance in which the thickened ink that the abnormal discharger D-F is filled with spreads to a deep portion of the abnormal discharger D-F as a result of vibrations that accompany the driving of adjacent supplementary dischargers D-Q in the same nozzle row Ln (the same recording head HD) propagating to the abnormal discharger D-F, and the thickened ink spreads further to the reservoir 350 via the ink supply opening 360.

Additionally, the controller 6 may be able to perform control of a printing process according to a shape priority printing mode for prioritizing the accuracy of the position or the shape of an image formed on a recording sheet P over the accuracy of the color of an image formed on a recording sheet P, a color priority printing mode for prioritizing the accuracy of the color of an image formed on a recording sheet P over the accuracy of the position or the shape of an image formed on a recording sheet P.

Further, in a case in which a supplementary printing process is executed by the shape priority printing mode, it is preferable that the controller 6 select a supplementary discharger D-Q from dischargers D that have a nozzle N belonging to a different nozzle row Ln than an abnormal discharger D-F. In addition, in a case in which a supplementary printing process is executed by the color priority printing mode, it is preferable that a supplementary discharger D-Q be selected from dischargers D that have a nozzle N belonging to the same nozzle row Ln as an abnormal discharger D-F.

Furthermore, in a case in which a supplementary printing process is executed by the color priority printing mode, the controller 6 may make the time from discharge state determination until the initiation of a maintenance process shorter than a case in which a supplementary printing process is executed by the shape priority printing mode. As a result of this, in a case in which a discharge abnormality caused by thickening of the ink has occurred in an abnormal discharger D-F when a supplementary printing process is executed by the color priority printing mode, it is possible to prevent the spread of thickened ink as a result of vibrations that accompany the driving of adjacent supplementary dischargers D-Q in the same nozzle row Ln propagating to the abnormal discharger D-F.

Additionally, among supplementary printing processes, in a case in which nozzles N of supplementary dischargers D-Q and a nozzle N of an abnormal discharger D-F belong to the same nozzle row Ln, for example, a case in which the supplementary dischargers D-Q and the abnormal discharger D-F are provided in the same recording head HD is referred to as a supplementary printing process by a same row supplementation mode (an example of a "first control mode").

In addition, among supplementary printing processes, in a case in which nozzles N of supplementary dischargers D-Q and a nozzle N of an abnormal discharger D-F belong to different nozzle rows Ln, for example, a case in which the supplementary dischargers D-Q and the abnormal discharger D-F are provided in the same recording head HD is referred to as a supplementary printing process by a different row supplementation mode (an example of a "second control mode").

Further, in the present modification example, the controller 6 performs control so that a first time, which is a time from discharge state determination until the initiation of a maintenance process in a case in which a supplementary printing process is executed by the same row supplementation mode, is shorter than a second time, which is a time from discharge state determination until the initiation of a maintenance process in a case in which a supplementary printing process is executed by the different row supplementation mode.

Modification Example 4

In the above-mentioned embodiment and modification examples, in the ink jet printer 1, four head units HU and four ink cartridges 31 are provided to correspond on a one-to-one basis, but the invention is not limited to such an aspect, and it is sufficient as long as the ink jet printer is provided with one head unit HU or more and one ink cartridge 31 or more.

In addition, in the above-mentioned embodiment and modification examples, four discharge state determination circuits 9 are provided in the ink jet printer 1 to correspond to the four head units HU on a one-to-one basis, but the invention is not limited to such an aspect, and in the ink jet printer 1, a single discharge state determination circuit 9 may be provided for a plurality of head units HU, or a plurality of discharge state determination circuits 9 may be provided for a single head unit HU.

Modification Example 5

In the above-mentioned embodiment and modification examples, the discharge state determination circuits 9 are provided as separate circuits to the controller 6, but the invention is not limited to such an aspect, a portion of or all of the discharge state determination circuits 9 may be mounted as a functional block that is realized as a result of the CPU, or the like, of the controller 6 operating in accordance with a control program.

Modification Example 6

In the above-mentioned embodiment and modification examples, the timing portion 63 is mounted as a functional block that is realized as a result of the controller 6 operating in accordance with a control program, but the invention is not limited to such an aspect, and the timing portion 63 may be mounted as a separate circuit to the controller 6 or as hardware.

For example, the timing portion 63 may be provided in an outer portion of the head module HM separately from the controller 6, and may perform timing of the time from the timing at which the discharge state determination circuits 9 output the determination information Stt, or the timing at which the residual vibration signal NES is supplied to the discharge state determination circuits 9. Further, it is sufficient as long as the time at which timing was initiated is set as a reference, it is determined whether or not the timing at which a maintenance process is to be initiated has been reached, and the controller 6 is notified of the fact that the timing at which a maintenance process is to be initiated has been reached in a case in which the timing at which a maintenance process is to be initiated has been reached.

In addition, in the above-mentioned embodiment and modification examples, the ink jet printer 1 is provided with a single timing portion 63, but the invention is not limited to such an aspect, and, for example, the ink jet printer 1 may include four timing portions 63 so as to correspond to the four head units HU or the four discharge state determination circuits 9 on a one-to-one basis.

For example, a timing portion 63 may be provided in each head unit HU inside the head module HM. For example, each of the four head units HU may be provided with a timing portion 63. In this case, it is sufficient as long as, for example, each of the four timing portions 63 provided in the head module HM sets the timing at which the detection circuit 20 outputs the residual vibration signal NES as a reference, determines whether or not the timing at which a maintenance process is to be initiated has been reached, and notifies the controller 6 of the fact that the timing at which a maintenance process is to be initiated has been reached in a case in which the timing at which a maintenance process is to be initiated has been reached. In this case, the timing at which the detection circuit 20 outputs the residual vibration signal NES may be deemed to be the timing at which the discharge state determination circuit 9 outputs the determination information Stt.

In addition, for example, a timing portion 63 may be provided in each discharge state determination circuit 9 inside the determination module CM. That is, each of the four discharge state determination circuits 9 may be provided with a timing portion 63. In this case, it is sufficient as long as, for example, each of the four timing portions 63 provided in the determination module CM sets the timing at which the discharge state determination circuits 9 output the determination information Stt or the timing at which the residual vibration signal NES is supplied to the discharge state determination circuit 9 as a reference, determines whether or not the timing at which a maintenance process is to be initiated has been reached, and notifies the controller 6 of the fact that the timing at which a maintenance process is to be initiated has been reached in a case in which the timing at which a maintenance process is to be initiated has been reached.

In such cases, since it is possible to establish the timing of a maintenance process in an individual manner for each head unit HU, it is possible to suggest the likelihood with which a severe discharge abnormality that cannot be repaired even if a maintenance process is used will occur in each head unit HU.

Modification Example 7

Figure 17:
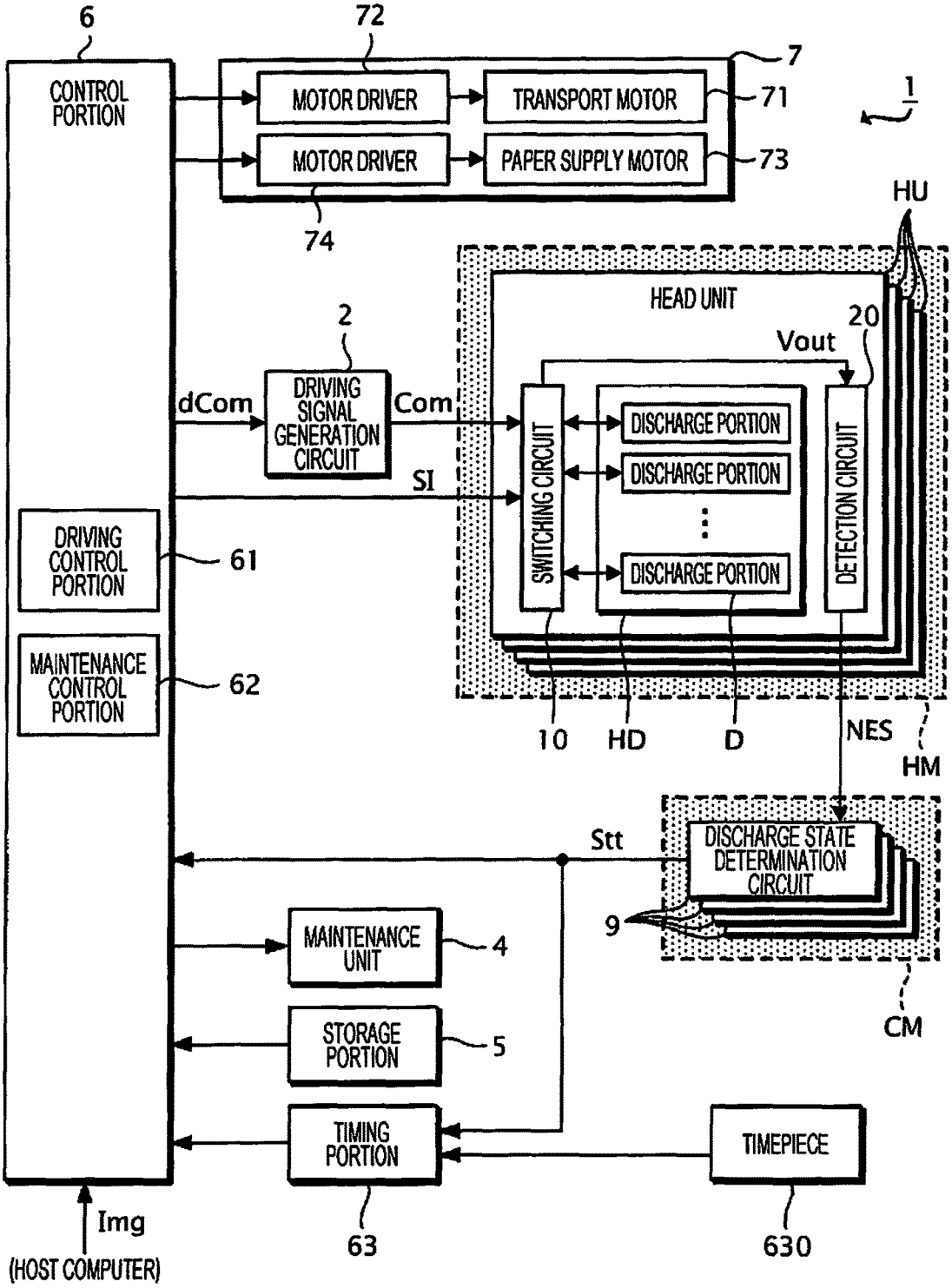
FIG. 17 is a block diagram that shows a configuration of an ink jet printer according to Modification Example 7.

In the above-mentioned embodiment and modification examples, as shown in FIG. 17, the ink jet printer 1 may be provided with a timepiece 630. More specifically, for example, the timepiece 630 may be capable of generating information related to time as a result of being provided with a RTC (real-time clock), which is a radio clock, and a function of acquiring information related to time from outside the ink jet printer 1 and correcting the time of the RTC on the basis of the acquired information. In this instance, for example, information related to time may be information related to time that is used outside the ink jet printer 1 in the manner of a standard time, or the like. In addition, for example, the function of acquiring information related to time from outside the ink jet printer 1 may adopt a function of receiving information related to time from a global positioning system (GPS) satellite, a function of acquiring information related to time from the Internet, or the like, as appropriate.

In addition, in the present modification example, the timing portion 63 may determine whether or not the timing at which a maintenance process is to be performed by referring to the timepiece 630 at a timing at which discharge state determination is executed, and periodically referring to the timepiece 630 thereafter. In other words, it is sufficient as long as the timing portion 63 sets the time at which discharge state determination was carried out as a reference, determines whether or not the timing at which a maintenance process is to be initiated has been reached on the basis of a difference between the reference and the current time, and notifies the controller 6 of the fact that the timing at which a maintenance process is to be initiated has been reached in a case in which the timing at which a maintenance process is to be initiated has been reached.

In addition, in FIG. 17, a case in which the timepiece 630 is provided separately from the timing portion 63 is illustrated by way of example, but the timepiece 630 may be provided in the timing portion 63. In other words, the timing portion 63 may include the timepiece 630.

Modification Example 8

In the above-mentioned embodiment and modification examples, a case in which the ink jet printer 1 is a serial printer is assumed, but the invention is not limited to such an aspect, and the ink jet printer 1 may be a so-called line printer in which a plurality of nozzles N are provided in the head module HM so as to extend to be wider than the width of a recording sheet P.

What is claimed is:

1. A liquid discharging apparatus comprising:

a plurality of dischargers that discharge a liquid;

a determination portion that determines discharge states of the liquid in the dischargers; and a controller that controls the plurality of dischargers, wherein, in a case in which the determination portion determines that the discharge state of the liquid in a first discharger is abnormal, the controller controls the plurality of dischargers so as to determine whether or not a predetermined time has elapsed since the determination that the discharge state of the liquid in the first discharger is abnormal, controls the plurality of dischargers so as to cause the liquid to be discharged from a second discharger instead of causing the liquid to be discharged from the first discharger until the predetermined time has elapsed since the determination that the discharge state of the liquid in the first discharger is abnormal, and controls the plurality of dischargers so that a repair operation, which repairs the discharge state of the liquid in the first discharger to normal, is automatically caused to be executed upon the predetermined time having elapsed since the determination that the discharge state of the liquid in the first discharger is abnormal.

2. The liquid discharging apparatus according to claim 1, wherein the repair operation is an operation in which the plurality of dischargers discharge the liquid.

3. The liquid discharging apparatus according to claim 1, further comprising:

a driving signal generation portion that generates a first driving signal that drives the dischargers in a manner in which the liquid is discharged from the dischargers, and a second driving signal that drives the dischargers in a manner in which the liquid is not discharged from the dischargers; and a switching portion that switches between supplying the first driving signal to the dischargers, and supplying the second driving signal to the dischargers, wherein, in a case in which the determination portion determines that the discharge state of the liquid in the first discharger is abnormal, the controller controls the switching portion so that the first driving signal and the second driving signal are not supplied to the first discharger until the predetermined time has elapsed since the determination of the discharge states of the liquid in the dischargers.

4. A liquid discharging apparatus comprising:

a plurality of dischargers that discharge a liquid;

a determination portion that determines discharge states of the liquid in the dischargers;

a repair mechanism that repairs the discharge state of the liquid in a discharger to normal in a case in which the discharge state of the liquid in the discharger becomes abnormal; and a controller that controls the plurality of dischargers and the repair mechanism, wherein, in a case in which the determination portion determines that the discharge state of the liquid in a first discharger is abnormal, the controller controls the plurality of dischargers so as to determine whether or not a predetermined time has elapsed since the determination that the discharge state of the liquid in the first discharger is abnormal, controls the plurality of dischargers so as to cause the liquid to be discharged from a second discharger instead of causing the liquid to be discharged from the first discharger until the predetermined time has elapsed since the determination that the discharge state of the liquid in the first discharger is abnormal, and controls the repair mechanism so that a repair operation, which repairs the discharge state of the liquid in the first discharger to normal, is automatically caused to be executed upon the predetermined time having elapsed since the determination that the discharge state of the liquid in the first discharger is abnormal.

5. The liquid discharging apparatus according to claim 4, wherein the repair operation is an operation in which the repair mechanism suctions the liquid from the plurality of dischargers.

6. A control method of a liquid discharging apparatus which includes a plurality of dischargers that discharge a liquid, and a determination portion that determines discharge states of the liquid in the dischargers, the method comprising, in a case in which the determination portion determines that the discharge state of the liquid in a first discharger is abnormal:

controlling the plurality of dischargers so as to determine whether or not a predetermined time has elapsed since the determination that the discharge state of the liquid in the first discharger is abnormal;

controlling the plurality of dischargers so as to cause the liquid to be discharged from a second discharger instead of causing the liquid to be discharged from the first discharger until the predetermined time has elapsed since the determination that the discharge state of the liquid in the first discharger is abnormal; and controlling the plurality of dischargers so that a repair operation, which repairs the discharge state of the liquid in the first discharger to normal, is automatically caused to be executed upon the predetermined time having elapsed since the determination that the discharge state of the liquid in the first discharger is abnormal.

* * * * *